US007556904B2

(12) United States Patent
Kadota et al.

(10) Patent No.: US 7,556,904 B2
(45) Date of Patent: Jul. 7, 2009

(54) TONER FOR ELECTROSTATIC DEVELOPMENT, DEVELOPER, IMAGE FORMING METHOD, IMAGE-FORMING APPARATUS AND PROCESS FOR CARTRIDGE USING THE SAME

(75) Inventors: Takuya Kadota, Kobe (JP); Masahide Inoue, Katsuragi (JP); Yoshihiro Mikuriya, Nishinomiya (JP); Katsunori Kurose, Takarazuka (JP); Masayuki Hagi, Minoo (JP); Minoru Nakamura, Takarazuka (JP); Hiroaki Kato, Nagaokakyo (JP); Atsushi Yamamoto, Kawanishi (JP); Hideaki Yasunaga, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 405 days.

(21) Appl. No.: 11/411,179

(22) Filed: Apr. 26, 2006

(65) Prior Publication Data

US 2006/0275686 A1 Dec. 7, 2006

(30) Foreign Application Priority Data

Apr. 28, 2005 (JP) ..... 2005-130691

(51) Int. Cl.
*G03G 9/08* (2006.01)

(52) U.S. Cl. ..... 430/108.1; 430/108.24; 430/108.6; 430/108.7

(58) Field of Classification Search ..... 430/108.1, 430/108.24, 108.6, 108.7
See application file for complete search history.

(56) References Cited

U.S. PATENT DOCUMENTS

| | | | | |
|---|---|---|---|---|
| 5,702,858 | A * | 12/1997 | Yuasa et al. | 430/108.6 |
| 5,705,306 | A * | 1/1998 | Kitani et al. | 430/108.22 |
| 2001/0002305 | A1 * | 5/2001 | Yuasa et al. | 430/110 |
| 2002/0086229 | A1 * | 7/2002 | Yuasa et al. | 430/108.4 |
| 2003/0157418 | A1 * | 8/2003 | Lee et al. | 430/108.3 |
| 2005/0053858 | A1 * | 3/2005 | Yuasa et al. | 430/109.4 |
| 2006/0275686 | A1 | 12/2006 | Kadota et al. | |
| 2008/0199234 | A1 | 8/2008 | Hagi et al. | |

FOREIGN PATENT DOCUMENTS

| | | |
|---|---|---|
| JP | 3-294864 | 12/1991 |
| JP | 4-214568 | 8/1992 |
| JP | 2769317 | 4/1998 |

(Continued)

OTHER PUBLICATIONS

U.S. Appl. No. 11/924,994, filed Oct. 26, 2007, Katoh, et al.

(Continued)

*Primary Examiner*—Hoa V Le
(74) *Attorney, Agent, or Firm*—Oblon, Spivak, McClelland, Maier & Neustadt, P.C.

(57) ABSTRACT

It is an object of the present invention to provide a toner containing toner particles and inorganic fine particles wherein the inorganic fine particles are externally added to the toner particles which contain a binder resin and a colorant and at least one type of the inorganic fine particles is a compound oxide having a relative permittivity measured at 1 MHz of 2 to 10 and a volume resistivity of 1011Ω·cm or more and an image forming method using the toner.

17 Claims, 6 Drawing Sheets

FOREIGN PATENT DOCUMENTS

| | | |
|---|---|---|
| JP | 11-95480 | 4/1999 |
| JP | 2933724 | 5/1999 |
| JP | 11-184239 | 7/1999 |
| JP | 3007693 | 11/1999 |
| JP | 2000-986667 | 4/2000 |
| JP | 3136756 | 12/2000 |
| JP | 2002-31913 | 1/2002 |
| JP | 2002-156782 | 5/2002 |
| JP | 2002-278143 | 9/2002 |
| JP | 2002-287409 | 10/2002 |
| JP | 2003-186240 | 7/2003 |
| JP | 2003-255592 | 9/2003 |
| JP | 2003-255593 | 9/2003 |
| JP | 2003-327470 | 11/2003 |
| JP | 2004-78206 | 3/2004 |
| JP | 3571900 | 7/2004 |

OTHER PUBLICATIONS

U.S. Appl. No. 11/857,175, filed Sep. 18, 2007, Matsumoto, et al.
U.S. Appl. No. 11/963,279, filed Dec. 21, 2007, Mikuriya, et al.
U.S. Appl. No. 11/616,198, filed Dec. 26, 2006, Takuya Kadota, et al.
U.S. Appl. No. 11/965,522, filed Dec. 27, 2007, Fuwa, et al.
U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/035,892, filed Feb. 22, 2008, Kadota, et al.
U.S. Appl. No. 12/046,784, filed Mar. 12, 2008, Nozaki, et al.
U.S. Appl. No. 12/046,866, filed Mar. 12, 2008, Matsumoto, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,663, filed Mar. 18, 2008, Izutani, et al.
U.S. Appl. No. 12/050,963, filed Mar. 19, 2008, Ishikawa, et al.
U.S. Appl. No. 12/051,248, filed Mar. 19, 2008, Hagi, et al.
U.S. Appl. No. 11/624,453, filed Jan. 18, 2007, Yamamoto, et al.
U.S. Appl. No. 11/670,257, filed Feb. 1, 2007, Hagi, et al.
U.S. Appl. No. 11/674,244, filed Feb. 13, 2007, Nakamura, et al.
U.S. Appl. No. 11/624,525, Jan. 18, 2007, Yasunaga, et al.
U.S. Appl. No. 12/010,369, filed Jan. 24, 2008, Yasunaga, et al.
U.S. Appl. No. 12/027,704, filed Feb. 7, 2008, Fuwa, et al.
Toshihiko Oguchi, "The Effects of Carrier and External Additives on the Tribocharging Properties of Toner", Journal of the Imaging Society of Japan, vol. 39, No. 3, Aug. 21, 2000, pp. 254-263.
U.S. Appl. No. 11/685,313, filed Mar. 13, 2007, Nozaki, et al.
U.S. Appl. No. 11/685,890, filed Mar. 14, 2007, Nozaki, et al.
U.S. Appl. No. 11/687,431, filed Mar. 16, 2007, Matsumoto, et al.
U.S. Appl. No. 11/684,131, filed Mar. 9, 2007, Yasunaga, et al.
U.S. Appl. No. 11/686,801, filed Mar. 15, 2007, Kato, et al.
U.S. Appl. No. 11/681,530, filed Mar. 2, 2007, Kadota, et al.
U.S. Appl. No. 11/687,352, filed Mar. 16, 2007, Kurose, et al.
U.S. Appl. No. 12/043,633, filed Mar. 6, 2008, Nakamura, et al.
U.S. Appl. No. 12/046,869, filed Mar. 12, 2008, Nozaki, et al.
U.S. Appl. No. 12/048,865, filed Mar. 14, 2008, Yasunaga, et al.
U.S. Appl. No. 11/696,879, filed Apr. 5, 2007, Yasunaga, et al.
U.S. Appl. No. 11/772,404, filed Jul. 2, 2007, Nakamura, et al.
U.S. Appl. No. 11/779,648, filed Jul. 18, 2007, Yamamoto, et al.
U.S. Appl. No. 11/851,048, filed Sep. 6, 2007, Murakami, et al.
U.S. Appl. No. 11/851,617, filed Sep. 7, 2007, Murakami, et al.
U.S. Appl. No. 11/851,783, filed Sep. 13, 2007, Nakamura, et al.
U.S. Appl. No. 11/855,759, filed Sep. 14, 2007, Katoh, et al.
U.S. Appl. No. 11/856,248, filed Sep. 17, 2007, Murakami, et al.
U.S. Appl. No. 11/855,739, filed Sep. 14, 2007, Fuwa, et al.

* cited by examiner

TONER FOR ELECTROSTATIC DEVELOPMENT, DEVELOPER, IMAGE FORMING METHOD, IMAGE-FORMING APPARATUS AND PROCESS FOR CARTRIDGE USING THE SAME

BACKGROUND OF THE INVENTION

1. Field of the Invention

The present invention relates to a toner for electrostatic development suitable for an image forming apparatus having a development apparatus which forms a thin layer by pressing a developing roller and a developer layer thickness control member and further having a unit which performs contact charging to the latent image bearing member, and a developer, an image forming method, an image forming apparatus and a process cartridge using the toner for electrostatic development respectively.

2. Description of the Related Art

The research and development relating to electrophotography have been conducted with all kinds of ingenuity and technical approaches. In electrophotography, a toner image is formed by developing a latent electrostatic image formed by charging and exposing the surface of a photoconductor using a color toner and an image is formed by transferring a toner image to a transferred medium such as transfer paper and by fixing it with a thermal roll.

An effective measures employed for electrophotography and electrostatic recording nowadays are dry developing methods including a method using a two-component developer made of toner and carrier and a method using a single component developer which does not contain carrier.

The two-component developer method is advantageous in handling of developers because the process for developing toner is carrier-mediated and it is easier to obtain appropriate images relatively stably when long-life and printing in high-speed region are required. However, since carrier deterioration and fluctuation of mixing ratio of toner and carrier are likely to occur, a constant quality of images in a prolonged period is difficult to obtain and there are drawbacks in maintenance and size reduction of apparatus, making single component developer method more advantageous in these points.

However, competitive regions of these methods are increasing with progress in heightening of image quality, size reduction, cost reduction, speeding up and the transition from black-and-white prints to color prints, and the scope of choices available to users is also being widened. And the operability including lightweight, compactness, exchange and maintenance, and handling are becoming important elements for office usage even with the two-component method.

Moreover, further speeding up has been extended even to the printing region and not only loading of pulverization toner but also loading of polymerization toner as a developer is increasing in both methods from the viewpoint of size reduction, conglobation and oilless fixation of toner in conjunction with these demands.

The demand for a developer with which characteristic of two-component method can be maximized, is suitable for use at a wide range of printing speeds and corresponds to simultaneous pursuit of long-life and high image quality and compact process is further increasing.

The issues associated with two-component developer to respond to above demands are as follows.

(1) Increase in charged amount associated with size reduction of the toner, electrification property change due to duration and enlargement of adhesive property (2) charging ability change due to contamination of carrier and member (3) adhesive condition change of external additives on the toner surface Various proposals have been given in order to settle above issues. For example, it is disclosed in Japanese Patent Application Laid-Open (JP-A) No. 2000-98667 that the stable electrification property can be obtained by containing spicular inorganic powder and spherical inorganic powder, of which the surfaces of fine particles are coated with metal oxides in carrier coating resin, thereby preventing contamination of the carrier surface by the material used for the toner and it is stated as an indicator of contamination resistance of developer.

And in Japanese Patent (JP-B) No. 3136756, it is disclosed that the charged amount change of toner is decreased by attaching a charge control agent used for toner and a charge control agent of homopolarity on the surface of binder carrier, thereby suppressing carrier spent.

The prevention of adhesion of inorganic oxide fine particles on the photoconductor in order to prevent filming by providing resin particles nonadhesive to the toner, which has a volume average particle diameter in the range of 0.5 μm to 8.0 μm, in the developer and by applying cushioning effect to the inorganic oxide external additives between toners by the resin is disclosed in JP-A No. 2002-156782 for the developer for developing latent electrostatic images which contains toner, to which inorganic oxide fine particles are externally added, and carrier. However, this does not stabilize electrification property of the toner.

It is disclosed in JP-A No. 2003-255592 and JP-A No. 2003-255593 that the charge property of the negatively charged toner, to which hydrophobic external additives are at least externally added to the toner base particles, can be stabilized by using at least hydrophobic aluminum oxide-silica dioxide compound oxide particles and hydrophobic metal oxide fine particles, which have larger work function than that of aluminum oxide-silica dioxide compound oxide particles, as external additives. It is disclosed in the above literatures that the image quality, in which occurrence of oppositely transferred toner and fog are suppressed, negative charge property is appropriate and transfer efficiency and charge are more stable for a prolonged period, can be obtained. However, only equivalent effect compared to the toner in which silica and alumina are added separately can be obtained and when the ratio of alumina is large, there are problems of fog, electrification property and environmentally-resistant durability in particular. Being small in particle diameter is also disadvantageous in obtaining above effects and the effects on member and carrier contamination and condition change of external additives on the toner surface are also small.

The electrification charge of the toner for two-component magnetic developer in a magnetic brush developing method as disclosed in JP-B No. 2769317 can be sustained in an appropriate range during developing and transfer by regulating the permittivity and dielectric loss tangent in a predetermined range.

In JP-A No. 2004-78206, it is disclosed that the toner particles containing at least carbon black, which are used with a magnetic carrier and releasing agent, can be a black toner with excellent electrification property and transfer property by setting the loss tangent of the toner, which is expressed by dielectric loss factor $\epsilon''$/permittivity $\epsilon'$ at a predefined frequency, to a predetermined value.

However, the charged amount of the toner in the two-component developer method could not be uniformized sufficiently by these methods disclosed in prior art.

The single component developer method is relatively easy to employ because of its simple and compact design as a developing system which is not carrier-mediated, however, it is disadvantageous in terms of printing speed or long-life and therefore, it is useful as a compact printer in a low-speed region with which user maintenance and exchanges are easy.

In this method, a toner (developer) is transported to the developing portion normally by at least one toner feeding member and a latent electrostatic image formed on the latent image bearing member is made visible by the fed toner, however, when it is operated such a way, a layer thickness of the toner fed on the surface of the toner feeding member must be thin as much as possible. And when single component developer and a toner having a high electrical resistance are used in particular, it is required to charge the toner by a development apparatus and the layer thickness of the toner must be particularly thin. If the toner layer is thick, a portion near the surface of toner layer is only charged and it becomes unlikely for the entire toner layer to be uniformly charged.

Therefore, various methods have been proposed for control unit of toner layer thickness (developer layer thickness control member) on the toner feeding member and a representative example include a toner layer thickness control in which a control blade is positioned facing the toner feeding member and a toner layer thickness is controlled by pressing the toner fed to the surface of the toner feeding member with a pressing member (control blade). Moreover, another example may be the one in which the same effect is obtained by bringing a roller in contact instead of using the blade.

The charging method of the photoconductor surface includes a method which uses noncontact wire discharge and a method which uses contact charge injection and micro discharge and the contact charging method is preferably used for oxides suppression which occur at discharging and downsizing of apparatus.

In the toner layer formed on the surface of a developing sleeve by the developer layer thickness control member during developing, the toner is not moved from the developing sleeve to the latent image on the latent image bearing member and charge-up phenomenon is likely to occur because the toner existing near the surface of the developing sleeve in the toner layer is charged extremely high and is strongly attracted to the surface of the developing sleeve by mirroring strength, making it immobile on the surface of the developing sleeve. In particular, the charge-up phenomenon is likely to occur in low humidity.

When the charge-up phenomenon occurs, it is unlikely that the toner in the upper portion of the toner layer formed on the developing sleeve is charged, decreasing the charged amount of toner and therefore, it is likely to result in background smear, toner leakage and toner dispersal in nonimage portions.

It is necessary to have a composition in which the charged amount of the toner in the toner layer formed on the developing sleeve can be uniformly controlled as much as possible, in order to suppress the phenomenon.

Various treating agents are used to settle above issues, however, they also pose problems.

In JP-A No. 2002-31913, for example, silicate magnesium minerals (attapulgite and cepiorite) have a high moisture content and charge defects are likely to occur even in a normal usage environment and the problems caused by charge defects such as background smear, toner leakage and toner dispersal are likely to occur. Moreover, since they have low Mohs hardness, filming on the photoconductors is likely to occur, leading to image defects such as image deletion.

Moreover, when silicone oil-treated silicate magnesium as disclosed in JP-A No. 3-294864 and JP-A No. 4-214568 is used, the deterioration of toner flowability and increase in amount of charge caused by silicone oil are induced leading to transport defects and density degradation in the development apparatus.

In JP-A No. 11-95480, a two-component developer consisting of a toner coated with silicate fine powder on which the surface is treated with hexamethylsilazane in a coating ratio of 60% to 100% and a carrier on which the surface is coated with a silicone resin, having a stable electrification property and sufficient flowability is disclosed. However, when a toner with a coating ratio of 60% to 100% is prepared by using silicate magnesium as a silicate fine powder, an oppositely charged toner is likely to occur, causing background smear if it is used as a negatively charged toner. It is because silicate magnesium is likely to be positively charged due to the effect of MgO part which is likely to be strongly positively charged as shown in a relation of electronegantivity ("Journal of the Imaging Society of Japan" vol. 39 (2000) No. 3, p. 255-262).

And when a titanic acid fine powder is used as a toner disclosed in JP-A No. 11-184239, the material itself has low resistance and the charge leakage is large and likely to cause background smear, toner leakage and toner dispersal.

Moreover, since titanic acid fine powder is likely to separate from the toner, when contact charging method is employed, the contact charging member is contaminated, charge defects of the latent electrostatic image bearing member is induced leading to image defects.

When titania is used as toner as disclosed in JP-A No. 2003-186240, since this material also has low resistance and high permittivity, adjustment of the content is difficult, and when a large amount is used, the charge leakage also becomes large leading to charge deterioration of the entire toner and when a small amount is used, charged amount is increased. In either cases, background smear, toner leakage and toner dispersal are likely to occur.

And at the same time, when titania of relatively large particle diameter is used, it is likely to separate from the toner, and when a contact charging method is employed, the contact charging member is contaminated, the charge defects of the latent electrostatic image bearing member is induced leading to image defects.

Furthermore, the charged amount of the toner in single component developer method could not be sufficiently uniformized by the methods disclosed in JP-A Nos. 2002-31913, 3-294864, 4-214568, 11-95480, 11-184239, 2003-186240 and "Journal of the Imaging Society of Japan" vol. 39 (2000) No. 3, p. 255-262.

SUMMARY OF THE INVENTION

An object of the present invention is to provide a toner which is capable of achieving equalization of charged amount and is used as one-component and two-component developers utilized for toner composition for electrostatic development used in copiers and printers based on electrophotographic technology and the image forming method utilizing the toner composition.

Secondary, an object of the present invention is to provide a toner for electrostatic development with which background smear does not occur and toner leakage of supplied toner caused by reset defects, which are induced from an excessive charge of toner on the developing roller, and streaks on the transported surface due to electrostatic aggregation are suppressed, and is capable of obtaining excellent image stability by performing friction charging between developing roller and developer layer thickness control member in the development apparatus effectively and uniformly.

Thirdly, an object of the present invention is to provide a toner composition for electrostatic development with which image defects such as image deletion caused by charge defects of photoconductors does not occur and operating life of the photoconductors are not deteriorated by preventing occurrence of filming and scratches on the photoconductors by using additives of appropriate hardness.

Forthly, an object of the present invention is to provide a nonmagnetic one-component image forming method and process cartridge with which background smear does not occur and toner leakage of supplied toner caused by reset defects, which are induced from an excessive charge of toner on the developing roller, and streaks on the transported surface due to electrostatic aggregation are suppressed and are capable of obtaining excellent image stability by performing friction charging between developing roller and developer layer thickness control member in the development apparatus effectively and uniformly wherein the composition of a thin layer forming material in the development apparatus is a combination of metal and resin.

Fifthly, an object of the present invention is to provide an image forming method and process cartridge with which degradation of resistance in charging member does not occur and charging performance is not deteriorated even when the contact member is contaminated with a composition in which the latent electrostatic image bearing member is charged by a contact method.

The toner of the present invention contains at least toner particles and inorganic fine particles which are externally added to the toner particles which contain a binder resin and a colorant and one type of the inorganic fine particles is a compound oxide having a relative permittivity measured at 1 MHz of 2 to 10 and a volume resistivity of $10^{11}\Omega\cdot$cm or more.

The single component developer of the present invention contains at least a toner wherein the toner at least contains toner particles and inorganic fine particles which are externally added to the toner particles which contain a binder resin and a colorant and at least one type of the inorganic fine particles is a compound oxide having a relative permittivity measured at 1 MHz of 2 to 10 and a volume resistivity of $10^{11}\Omega\cdot$cm or more.

The two-component developer of the present invention contains at least a toner and a carrier, wherein the toner at least contains toner particles and inorganic fine particles which are externally added to the toner particles which contain a binder resin and a colorant and at least one type of the inorganic fine particles is a compound oxide having a relative permittivity measured at 1 MHz of 2 to 10 and a volume resistivity of $10^{11}\Omega\cdot$cm or more.

The image forming method of the present invention contains at least forming of a latent electrostatic image on a latent electrostatic image bearing member, developing of the latent electrostatic image using a toner to form a visible image, transferring of the visible image to a recording medium and fixing of the transferred image on the recording medium.

The image-forming apparatus of the present invention contains at least a latent electrostatic image bearing member, latent electrostatic image forming unit configured to form a latent electrostatic image on the latent electrostatic image bearing member, developing unit configured to develop the latent electrostatic image using a toner to form a visible image, transfer unit configured to transfer the visible image to a recording medium, and fixing unit configured to fix the transferred image on the recording medium.

The process cartridge of the present invention contains at least a latent electrostatic image bearing member, a developing unit configured to develop a latent electrostatic image formed on the latent electrostatic image bearing member using a toner to form a visible image wherein the process cartridge can be attached to and removed from the image-forming apparatus main body.

DESCRIPTION OF THE PREFERRED EMBODIMENTS (Toner)

Figure 1:
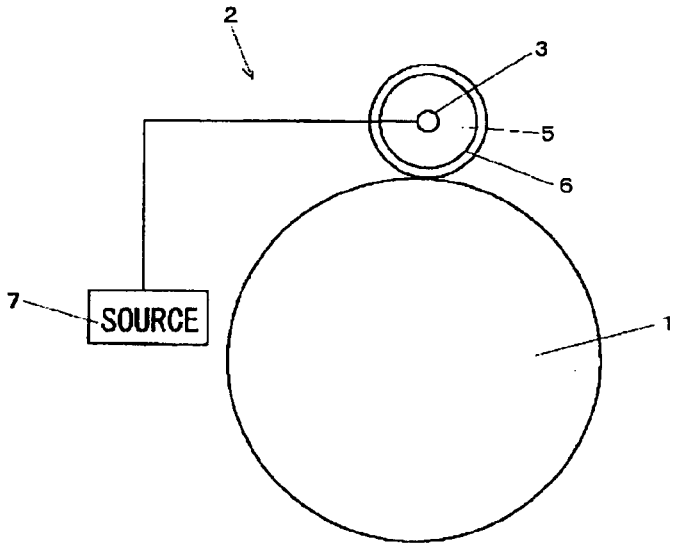
FIG. 1 is a diagram showing an exemplary charging member employed in the image forming method of the present invention.

The toner of the present invention at least contains toner particles having a binder resin and a colorant and on which inorganic fine particles are externally added, and further contains other elements as necessary.

At least one type of the inorganic fine particles is an inorganic fine particle of compound oxide which has a relative permittivity measured at 1 MHz of 2 to 10 and a volume resistivity of $10^{11}\Omega\cdot$cm or more.

The relative permittivity measured at 1 MHz of the compound oxide is 2 to 10 and preferably 3 to 9 for the purpose of assisting electrification property of the toner particles. The volume resistivity of the compound oxide is $10^{11}\Omega\cdot$cm or more and preferably $10^{12}\Omega\cdot$cm or more.

When the relative permittivity is less than 2, it does not function as charge assisting agent and when it is more than 10, it causes charge-ups and the charge of toner inside a development apparatus becomes uneven. Moreover, when the volume resistivity is less than $10^{11}\Omega\cdot$cm, surface resistance is deteriorated when it is attached to the charging member for charging the latent electrostatic image bearing member and causes charge defects of the latent electrostatic image bearing member.

Furthermore, compounds expressed by the following General Formula (1) are preferably used as compound oxides.

$$[M1]_a Si_b O_c \qquad \text{General Formula (1)}$$

Where, in the above General Formula (1), "M1" represents a metal element selected from Sr, Mg, Zn, Co, Mn and Ce, "a" and "b" represent an integer of 1 to 9 and "c" represents an integer of 3 to 9.

Furthermore, the compound oxide is preferably a magnesium silicate compound expressed by the following General Formula (2).

$$Mg_aSi_bO_c \qquad \text{General Formula (2)}$$

Where, in the above General Formula (2), "a" and "b" represent an integer of 1 to 9 and "c" represents c=a+2b.

It is preferably one type at least selected from a group of forsterite ($Mg_2SiO_4$), steatite ($MgSiO_3$) and enstatite for bringing out more effect of the present invention in particular.

The primary particle diameter of the compound oxide is preferably 0.05 μm to 1 μm and more preferably 0.08 μm to 1 μm. When the primary particle diameter is less than 0.05 μm, it is buried by the stress in thin-layer forming portion of a development apparatus and may not be able to bring out the effect at the end of duration and when it is more than 1 μm, the compound oxide is separated from the toner surface and may not be also able to bring out the effect at the end of duration.

The content of the compound oxide is preferably 0.1 parts by mass to 5.0 parts by mass, more preferably 0.1 parts by mass to 1.5 parts by mass and most preferably 0.2 parts by mass to 1.5 parts by mass relative to 100 parts by mass of the toner particles. When the content is less than 0.1 parts by mass, it cannot bring out the effect of assisting charge and causes charge-ups which result in uneven charge of toner inside the development apparatus. When the content is more than 5.0 parts by mass, oppositely-charged toner is likely to generate when it is used as a negatively-charged toner and background smear is likely to occur.

Moreover, the content of the compound oxide in single component developer is preferably 0.1 parts by mass to 1.5 parts by mass and more preferably 0.2 parts by mass to 1.5 parts by mass relative to 100 parts by mass of the toner particles. When the content is less than 0.1 parts by mass, it cannot bring out the effect of assisting charge and causes charge-ups which result in uneven charge of the toner inside the development apparatus. When the content is more than 1.5 parts by mass, oppositely-charged toner is likely to generate when it is used as a negatively-charged toner and the background smear is likely to occur.

The content of the compound oxide in two-component developer is preferably 0.1 parts by mass to 5 parts by mass, more preferably 0.3 parts by mass to 3 parts by mass and most preferably 0.3 parts by mass to 2.0 parts by mass relative to 100 parts by mass of the toner particles. When the content is less than 0.1 parts by mass, it cannot bring out the effect of assisting charge and causes charge-ups which result in uneven charge of the toner inside the development apparatus. When the content is more than 5 parts by mass, oppositely-charged toner is likely to generate when it is used as a negatively-charged toner and background smear and contamination due to separation are likely to occur.

Magnesium silicate is likely to be positively charged due to MgO part which is likely to be strong positively charged as expressed by the relation of electronegativity ("Journal of the Imaging Society of Japan" vol. 39, third issue, p. 259).

Moreover, damages given to the photoconductor are prevented by having a Mohs hardness of external additives of 4.5 to 8. When the Mohs hardness is less than 4.5, filming on the photoconductor occur leading to inadequate charging and causes image deletion. When the Mohs hardness is more than 8, photoconductor is scraped causing scratches on the photoconductor which leads to image defects and the longevity is significantly reduced.

The adherence of forsterite and steatite to metals is extremely weak even though the reason is not known. It is believed that since they differ from conductivity providing materials in having small amount of saturated charge due to low permittivity and in having high charge retaining capability due to high volume resistance, they suppress excessive and redundant charges with metals and members which are likely to become charged without impairing electrification property of the toner which leads to the suppression of adhesive property of the toner.

Therefore, when the thin-layer forming member inside a development apparatus is a metal, it suppresses attachment of toner to the metal. When a metal roller is used, they promote prevention of filming and improvement of toner reset property and when a metal blade is used, they have an effect on filming prevention.

The toner particles which can be used in the present invention contain a binder resin, colorant and other additives in general. Examples of the toner particles include: (1) a toner particle which can be obtained by melt mixing and uniformly dispersing a colorant, charge control agent and releasing agent in a thermoplastic resin, which is an element of binder resin, to create a composition and by crushing and classifying the composition; (2) a toner particle which can be obtained by melting or suspending a colorant, charge control agent and releasing agent in a polymerizable monomer which is a law material for binder resin, adding a polymerization initiator, dispersing in an aqueous dispersion medium containing a dispersion stabilizer, heating up to a specific temperature to initiate suspension polymerization, and by filtering, washing, dehydrating and drying after polymerization; (3) a toner particle which can be obtained by adding a colorant and charge control agent to agglomerate primary particles of the binder resin containing polar radical obtained from emulsion polymerization to create secondary particle, and by filtering and drying of the particle which is further stirred and assembled at a temperature higher than the glass transition temperature of the binder resin and (4) a toner particle obtained by phase change emulsion in which after a colorant is added to a resin containing hydrophilic radical as a binder resin and the resin is melted in an organic solvent, it is then neutralized for phase change and dried to obtain a colored particle, and any of these toner particles can be used.

The explanation will be referred to, but not be limited to the pulverization toner.

<Binder Resin>

The types of binder resin are not particularly limited and may be known binder resins in the field of full-color toners such as polyester resin, (meth)acrylic resin, styrene-(meth) acrylic copolymer resin, epoxy resin, COC (cyclic olefin resin such as TOPAS-COC manufactured by Ticona), etc. and it is preferable to use polyester resin from the viewpoint of stress resistance in a development apparatus.

The examples of the polyester resin preferably used for the present invention include a polyester resin which is obtained through polycondensation of polyvalent alcohol component and polyvalent carboxylic acid component. Examples of bivalent alcohol component included in the polyvalent alcohol component include bisphenol A-alkylene oxide adduct such as polyoxypropylene (2,2)-2,2-bis(4-hydroxyphenyl) propane, polyoxypropylene (3,3)-2,2-bis(4-hydroxyphenyl) propane, polyoxypropylene (6)-2,2-bis(4-hydroxyphenyl) propane and polyoxyethylene (2,0)-2,2-bis(4-hydroxyphenyl) propane, ethylene glycol, diethylene glycol, triethylene glycol, 1,2-propylene glycol, 1,3-propylene glycol, 1,4-butandiol, neopentyl glycol, 1,4-butendiol, 1,5-pentanediol, 1,6-hexanediol, 1,4-cyclohexanedimethanol, dipropylene glycol, polyethylene glycol, polytetramethylene glycol, bisphenol A and hydrogenated bisphenol A.

Examples of trivalent or more alcohol components include sorbitol, 1,2,3,6-hexanetetrol, 1,4-sorbitan, pentaerythritol, dipentaerythritol, tripentaerythritol, 1,2,4-butantriol, 1,2,5-pentantriol, glycerol, 2-methylprop anetriol, 2-methyl-1,2,4-butantriol, trimethyrolethane, trimethyrolpropane, and 1,3,5-trihydroxymethylbenzene.

Furthermore, examples of bivalent carboxylic acid component of polyvalent carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid and anhydrides thereof or lower alkylester.

Examples of trivalent or more carboxylic acid components include 1,2,4-benzenetricarboxylic acid (trimellitic acid), 1,2,5-benzentricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, enpol trimeric acid and anhydrides thereof or lower alkylester.

Furthermore, a resin (hereinafter, referred to as "vinyl polyester resin") obtained by performing condensation polymerization for obtaining polyester resin and radical polymerization for obtaining vinyl resin simultaneously in a same container using a mixture of a basic monomer of polyester resin, basic monomer of vinyl resin and a monomer which reacts with the basic monomers of both resins is also favorable for use as a polyester resin of the present invention. Meanwhile, a monomer which reacts with basic monomers of both resins is defined as a monomer which can be used for both reactions of condensation polymerization and radical polymerization. In other words, it is a monomer having a carboxyl group which is reactable in condensation polymerization and a vinyl group which is reactable in radical polymerization and examples of such monomer include fumaric acid, maleic acid, acrylic acid and methacrylic acid.

Examples of basic monomers of polyester resin include above-mentioned polyvalent alcohol components and polyvalent carboxylic acid components.

Examples of basic monomers of vinyl resin include styrene or styrene derivatives including styrene, o-methylstyrene, m-methylstyrene, p-methylstyrene, α-methylstyrene, p-ethylstyrene, 2,4-dimethylstyrene, p-tert-butylstyrene and p-chlorstyrene; ethylene unsaturated monoolefins including ethylene, propylene, butylene and isobutylene; methacrylic acid alkylesters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkylesters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate and dodecyl acrylate; and unsaturated carboxylic acids such as acrylic acid, methacrylic acid, itaconic acid and maleic acid; acrylonitrile, maleic acid ester, itaconic acid ester, vinyl chloride, vinyl acetate, benzoic acid vinyl, vinyl methyl ethyl ketone, vinyl hexyl ketone, vinyl methyl ether, vinyl ethyl ether and vinyl isobutyl ether.

Examples of polymerization initiator which is used for initiating polymerization of basic monomers of vinyl resin include azo-based or diazo-based polymerization initiators such as 2,2'-azobis(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile and peroxide-based polymerization initiators such as benzoyl peroxide, dicumyl peroxide, methyl ethyl ketone peroxide, isopropyl peroxycarbonate and lauroyl peroxide.

Various polyester resins as described above are preferably used as binder resins and of these, parallel usage of a first binder resin and a second binder resin is preferable and effective for further improvement of stripping and offset resistance as a toner for oilless fixation.

A polyester resin obtained by condensation polymerization of above-mentioned polyvalent alcohol components and polyvalent carboxylic acid components and in particular, a polyester resin obtained by using bisphenol A-alkylene oxide adduct as a polyvalent alcohol component and terephthalic acid and fumaric acid as polyvalent carboxylic components is used as the first binder resin.

Particularly, a vinyl polyester resin in which bisphenol A-alkylene oxide adduct, terephthalic acid, trimellitic acid and succinic acid are used as basic monomers of the polyester resin, styrene and butylacrylate are used as basic monomers of vinyl resin, and fumaric acid is used as a monomer which is reactable in both reactions, is used as the second binder resin.

It is preferable for a hydrocarbon wax to be internally added during synthesis of the first binder resin in the present invention. In order to internally add hydrocarbon wax to the first binder resin in advance, the synthesis of the first binder resin is performed while hydrocarbon wax is added to the monomer for synthesizing the first binder resin. For example, condensation polymerization may be performed while hydrocarbon wax is added to oxygen monomer and alcohol monomer organizing the polyester resin as the first binder resin. When the first binder resin is a vinyl polyester resin, condensation polymerization and radical polymerization may be performed by allowing basic monomer of vinyl resin to drip while stirring and heating the monomer after hydrocarbon wax is added to the basic monomer of the polyester resin.

<Releasing Agent (Wax)>

Generally, releasing agents (waxes) which are low in polarity excel in releasing ability with a fixing member roller.

The wax which is used in the present invention is a hydrocarbon wax which is low in polarity and it is advantageous in oilless and low-temperature fixing. It is not limited to these waxes, and the toner with no wax added may also be used. Moreover, high-viscosity wax may be used for improving high-temperature offset or low-molecular wax for improving peeling strength and a wax with which oxidation is adjusted may be used accordingly from the viewpoint of solubility with the resin.

—Hydrocarbon Wax—

A hydrocarbon wax is a wax consisting only of carbon and hydrogen atoms and does not contain ester group, alcohol group or amide group. Specific examples of hydrocarbon wax which are internally added to the resin include polyolefin waxes such as polyethylene, polypropylene and copolymer of ethylene and propylene, petroleum waxes such as paraffin wax and microcrystalline wax and synthesized waxes such as Fischer Tropsch wax. Of these, the preferred waxes of the present invention are polyethylene wax, paraffin wax and Fischer Tropsch wax and more preferred waxes are polyethylene wax and paraffin wax.

When the wax is not internally added to the resin, in other words if the resin is used for monochrome high-speed machines for example, the resin is preferably containing polypropylene wax from the viewpoint of improving offset resistance and it is preferably containing polyethylene wax from the viewpoint of improving smear (a phenomenon in which an image is scraped with rollers causing image deterioration such as scatter and smear when a paper of which the image is already formed on one side is transported during automatic document feeding or two-sided printing). The polypropylene wax which is particularly preferable from above viewpoints is a polypropylene wax having a melt viscosity of 50 cps to 300 cps at 160° C., a softening point of 130° C. to 160° C. and an acid value of 1 mgKOH/g to 20 mgKOH/g. And particularly preferable polyethylene wax is a polyethylene wax having a melt viscosity of 1,000 cps to 8,000 cps at 160° C. and a softening point of 130° C. to 150° C. In other words, a polypropylene wax having above melt viscosity, softening point and acid value excels in dispersibility in the binder resin and can improve offset resistance without having problems with isolation wax.

Moreover, a polyethylene wax having above melt viscosity and softening point also excels in dispersibility in the binder resin and can improve smear by lowering friction coefficient of the surface of fixed images without having problems with isolation wax. Meanwhile, the melt viscosity of wax is a value measured by means of Brookfield viscometers.

The melting point of the wax of the present invention is an endothermic peak of the wax measured by means of a differential scanning calorimeter (DSC) during heating and it is preferably in the range of 70° C. to 90° C. When it is more than 90° C., melting of wax in the fixing process becomes insufficient making it impossible to secure stripping with fixing member. When it is less than 70° C., problems arise in storage stabilities such as fusion between toner particles in a high-temperature, high-humidity environment. In order to have wider range of stripping at a low temperature, the melting point of wax is preferably 70° C. to 85° C. and more preferably 70° C. to 80° C.

Furthermore, the endothermic peak of wax during heating measured by means of a differential scanning calorimeter (DSC) is preferably having a half width of 7° C. or less. Since the melting point of the wax in the present invention is relatively low, the wax of which the endothermic peak is broad, in other words, the wax which melts at a low-temperature region has harmful effect on the storage stability of the toner.

The content of the wax in the toner of the present invention is preferably in the range of 1% by mass to 10% by mass, more preferably 1% by mass to 8% by mass and most preferably 2% by mass to 6.5% by mass. If the content of the wax is less than 1% by mass, the amount of wax which exude in between melting toner and fixing member during fixing process is not sufficient and adhesive property between melting toner and fixing member is not lowered therefore, recording member does not separate from the fixing member. On the other hand, if the content of the wax is more than 10% by mass, it is unfavorable because the amount of wax exposed on the toner surface increases and transcription efficiencies from developing unit to photoconductor and from photoconductor to recording member are lowered by the deterioration in flowability of toner particles and not only the image quality is significantly lowered but the contamination of developing member or photoconductors is also induced by the separation of wax on the toner surface.

—Content Ratio of First Binder Resin and Second Binder Resin—

The content ratio of the first binder resin (including mass of internally added wax) and the second binder resin is preferably 80/20 to 55/45 and more preferably 70/30 to 60/40 in mass ratio. If the first binder resin lacks in amount, it poses problems due to lowered stripping and high-temperature offset resistance. If the content of the first binder resin is too much, luster and heat-resistant storage property are deteriorated.

More preferably, the softening point of the binder resin containing the first binder resin and the second binder resin used in above mass ratio is 100° C. to 125° C. and particularly preferably 105° C. to 125° C. The softening point of the binder resin containing the first binder resin in which wax is internally added and the second binder resin, which falls within the above range is favorable for the present invention.

The acid value of the first binder resin in which wax is added internally is preferably 5 mgKOH/g to 50 mgKOH/g and more preferably 10 mgKOH/g to 40 mgKOH/g. The acid value of the second binder resin is preferably 0 mgKOH/g to 10 mgKOH/g and more preferably 1 mgKOH/g to 5 mgKOH/g. When a polyester resin is used in particular, the dispersibility of various colorants can be improved and the toner will have a sufficient charged amount by using a resin having above acid values.

The first binder resin is preferably containing an element which is insoluble in tetrahydrofran (THF) from the viewpoint of high-temperature offset resistance. The content of an element insoluble in THF in the first binder resin in which wax is added internally is preferably 0.1% by mass to 15% by mass, more preferably 0.2% by mass to 10% by mass and most preferably 0.3% by mass to 5% by mass.

<Colorant>

The colorants usable in the present invention include known pigments and dyes which have been used as colorants of full-color toners. Examples include carbon black, aniline blue, carcoil blue, chrome yellow, ultramarine blue, DuPont-oil red, quinoline yellow, methylene blue chloride, copper phthalocyanine, malachite green oxalate, lamp black, rose bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Pigment Yellow 74, C.I. Solvent Yellow 162, C.I. Pigment Yellow 180, C.I. Pigment Yellow 185, C.I. Pigment Blue 15:1 and C.I. Pigment Blue 15:3.

The content of the colorant in the toner particles is preferably 2 parts by mass to 15 parts by mass relative to 100 parts by mass of all binder resins. It is preferable to use colorant with a configuration of a masterbatch dispersed in the mixed binder resin of the first binder resin and the second binder resin in terms of dispersibility. The content of the masterbatch should be such that the amount of contained colorant falls within the above range. The content ratio of the colorant in the masterbatch is preferably 20% by mass to 40% by mass.

The colorant used in the present invention can be used as a masterbatch combined with a resin. Examples of the binder resin kneaded with manufacture of masterbatch or masterbatch include styrenes and polymers of substitution product thereof such as polystyrene, poly p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer; polymethylmethacrylate, polybutylmethacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin and paraffin wax other than above modified and unmodified polyester resins. These may be used alone or in combination.

The masterbatch can be obtained by mixing and kneading a colorant and a resin for masterbatch with high shear force. An organic solvent may be employed for heightening mutual interaction between the colorant and the resin during mixing and kneading. And a method so-called flushing in which aqueous paste containing colorant water is mix kneaded with a resin and organic solvent to transfer the colorant to the resin side and water and organic solvent components are removed is preferably used because wet cake of the colorant can be used as it is and drying is not necessary. High-shear dispersion apparatuses such as triple-roll mill are preferably used for mix kneading.

—Charge Control Agent—

The known charge control agents which have been used in full-color toners may be used for the toner of the present invention.

Examples include nigrosine dye, triphenylmethane dye, chlome-contained metal complex dye, molybdic acid chelate pigment, rhodamine dye, alkoxy amine, quaternized ammonium salt (including fluorine-modified quaternized ammonium salt), alkylamide, simple phosphorus or compound thereof, simple tungsten or compound thereof, fluorine activator, metal salicylate and metal salt of salicylic derivative. Specific examples include Bontron 03, a nigrosine dye, Bontron P-51, a quaternized ammonium salt, Bontron S-34, a metal-contained azo dye, E-82, oxynaphthoic acid metal complex, E-84, salicylic acid metal complex and E-89, a phenol condensate manufactured by Orient Chemical Industries, Ltd.; TP-302 and TP-415, molybdic complex of quaternized ammonium salt manufactured by Hodogaya Chemical Co., Ltd.; Copycharge PSY VP2038 of a quaternized ammonium salt, Copyblue PR of a triphenylmethane derivative and Copycharge NEG VP2036 and NX VP434 of quaternized ammonium salt manufactured by Hoechst Co.; LRA-901 and LR-147, a boron complex manufactured by Japan Carlit Co., Ltd; copper phthalocyanine, perylene, quinacridone, azo pigment and high polymer compound having functional group such as sulfonate group, carboxyl group and quaternized ammonium salt.

Of these, materials which control the toner to have a negative polarity are preferably used.

The used amount of the charge control agent is determined by types of binder resin, use or disuse of additives accordingly and manufacturing method of toner including dispersion method and is not limited unambiguously, however, it is preferably used in the range of 0.1 parts by mass to 10 parts by mass relative to 100 parts by mass of binder resin. It is preferably in the range of 0.2 parts by mass to 5 parts by mass. If it is more than 10 parts by mass, electrification property of the toner is too excessive that the effect of the charge control agent is weakened and electrostatic attraction with the developing roller is increased and may lead to deterioration of flowability of developer and image density.

—External Additive—

Other inorganic fine particles may be used as external additives for assisting flowability, developing ability and electrification property with the compound oxide in the present invention.

Specific examples of inorganic fine particles include silicon oxide, zinc oxide, tin oxide, silica sand, titanic oxide, clay, mica, sand-lime rock, diatom earth, chrome oxide, cerium oxide, colcothar, antimony trioxide, magnesium oxide, aluminum oxide, zirconium oxide, barium sulfate, barium carbonate, calcium carbonate, silicon carbide and silicon nitride.

The total content of the external additives in the present invention is preferably 1.0 part by mass to 5.0 parts by mass, more preferably 0.3 parts by mass to 3.0 parts by mass and most preferably 0.3 parts by mass to 2.0 parts by mass relative to the toner particles. If the total content of the external additives is more than above range, fog, developing ability and stripping are deteriorated. If the total content of the external additives is less than above range, flowability, transfer property and heat-resistant storage property are deteriorated.

The compound oxide fine particles may be internally added to the toner during manufacture of the toner and the content is preferably 0.1 parts by mass to 5.0 parts by mass relative to the toner particles. It is more preferably 1 part by mass to 5.0 parts by mass and most preferably 2 parts by mass to 5 parts by mass. If it is less than the above range, the ratio of exposure on the toner surface would be too low and becomes ineffective. If it is more than the above range, light permeableness and coloring ability are inhibited.

The toner of the present invention can be obtained by mixing, kneading, crushing and classifying the first binder resin in which above hydrocarbon wax is internally added, the second binder resin and the colorant to obtain toner particles (colored resin particles) having desired particle diameter and mixing with external additives. The average particle diameter of the toner particle is 4 μm to 10 μm and it is preferably 5 μm to 10 μm.

(Developer)

The developer of the present invention contains at least the toner of the present invention and further contains other appropriately selected components such as the aforementioned carrier. The developer can be either single component developer or two-component developer. However, the two-component developer is preferable in terms of improved life span when the developer is used, for example, in a high-speed printer that corresponds to the improvement of recent information processing speed.

The single component developer using the toner of the present invention exhibits less fluctuation in the toner particle diameter after toner inflow/outflow, and the toner filming on the developing roller or the fusion of toner onto the members such as blades for reducing toner layer thickness are absent, therefore providing excellent and stable developing property and images over long-term use (stirring) of the development apparatus. The two-component developer using toner of the present invention exhibits less fluctuation in the particle diameter of the toner in the developer after toner inflow/outflow for prolonged periods, and the excellent and stable developing property can be obtained after stirring in a development apparatus for prolonged periods.

The carrier is not particularly limited and may be selected accordingly. It is preferably the one having a core material and a resin layer applied on the core material.

The core material is not particularly limited and may be selected from known materials. For example, 50 emu/g to 90 emu/g of manganese-strontium (Mn—Sr) materials, manganese-magnesium (Mn—Mg) materials, and the like are preferred. Highly magnetizable materials such as iron powder (100 emu/g or more), magnetite (75 emu/g to 120 emu/g), and the like are preferred in terms of ensuring appropriate image density. Weak magnetizable materials such as copper-zinc (Cu—Zn) materials (30 emu/g to 80 emu/g) are preferred in terms of reducing the impact on photoconductor where toner is forming a magnetic brush, therefore advantageous for improving image quality. These may be used alone or in combination.

The volume average particle diameter of the core material is preferably 10 μm to 150 μm and more preferably 40 μm to 100 μm.

When the average particle diameter (volume average particle diameter ($D_{50}$)) is less than 10 μm, the amount of fine powder in the carrier particle distribution increases whereas magnetization per one particle decreases resulting in carrier dispersal. When the average particle diameter is more than 150 μm, the specific surface area decreases and causes carrier dispersal. Therefore, for a full-color image having many solid parts, reproduction of the solid parts in particular may be insufficient.

The material of resin layer is not particularly limited and may be selected from known resins accordingly. Examples of resin material include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymers of vinylidene fluoride and acryl monomer, copolymers of vinylidene fluoride and vinyl fluoride, fluoroterpolymer such as terpolymer of tetrafluoroethylene, vinylidene fluoride and non-fluoride monomer, silicone resin, and the like. These may be used alone or in combination.

Examples of amino resin include urea-formaldehyde resin, melamine resin, benzoguanamine resin, urea resin, polyamide resin, epoxy resin, and the like. Examples of polyvinyl resin include acryl resin, polymethylmetacrylate resin, polyacrylonitrile resin, polyvinyl acetate resin, polyvinyl alcohol resin, polyvinyl butyral resin, and the like. Examples of polystyrene resin include polystyrene resin, styrene acryl copolymer resin, and the like. Examples of halogenated olefin resin include polyvinyl chloride, and the like. Examples of polyester resin include polyethyleneterephtalate resin and polybutyleneterephtalate resin, and the like.

The resin layer may contain, for example, conductive powder, etc. as necessary. Examples of conductive powder include metal powder, carbon black, titanium oxide, tin oxide, zinc oxide, and the like. The average particle diameter of conductive powder is preferably 1 μm or less. When the average particle diameter is more than 1 μm, controlling electrical resistance may be difficult.

The resin layer may be formed by, for example, dissolving silicone resin, etc. in a solvent to prepare a coating solution, uniformly applying the coating solution to the surface of core material by known method, drying and baking. Examples of application method include immersion, spray, brushing, etc.

The solvent is not particularly limited and may be selected accordingly. Examples of solvent include toluene, xylene, methyethylketone, methylisobutylketone, Cerusolve, butylacetate, and the like.

The baking is not particularly limited and may be done by external heating or internal heating. Examples of baking method include the one using fixed electric furnace, flowing electric furnace, rotary electric furnace, burner or microwave.

The content of resin layer in the carrier is preferably 0.01% by mass to 5.0% by mass. When it is less than 0.01% by mass, the resin layer may not be formed uniformly on the surface of the core material. When it is more than 5.0% by mass, the resin layer may become excessively thick causing granulation between carriers, and the uniform carrier particles may not be obtained.

When developer is a two-component developer, the content of the carrier in the two-component developer is not particularly limited and may be selected accordingly. For example, the content is preferably 90% by mass to 98% by mass and more preferably 93% by mass to 97% by mass.

Because the developer of the present invention contains the toner, it has excellent transfer and fixing properties and is capable of forming high-quality images stably.

The developer of the present invention may be suitably used in forming images by various electrophotographic methods known in the art such as magnetic one-component developing, non-magnetic one-component developing, two-component developing, and the like. In particular, the developer of the present invention may be suitably used for process cartridge, image forming apparatus and image forming method of the present invention as described below.

(Image Forming Method and Image Forming Apparatus)

The image forming method of the invention include at least latent electrostatic image forming, developing, transferring, fixing and other steps such as discharging, cleaning, recycling, controlling, etc. as necessary.

The image forming apparatus of the invention contains at least latent electrostatic image bearing member, latent electrostatic image forming unit, developing unit, transfer unit, fixing unit and other units such as charge-eliminating unit, cleaning unit, recycling unit and control unit as necessary.

—Latent Electrostatic Image Forming and Latent Electrostatic Image Forming Unit—

The latent electrostatic image forming is a step that forms a latent electrostatic image on the latent electrostatic image bearing member.

Materials, shapes, structures or sizes, etc. of the latent electrostatic image bearing member (may be referred to as "optical conductive insulator" or "photoconductor") are not limited and may be selected from known photoconductors accordingly and it is preferably drum-shaped. The materials thereof are, for example, inorganic photoconductors such as amorphous silicon, selenium; organic photoconductors such as polysilane, phthalopolymethine, and the like. Of these examples, amorphous silicon is preferred for its longer operating life.

The latent electrostatic image may be formed, for example, by uniformly charging the surface of the photoconductor and irradiating it imagewise, and this may be performed by the latent electrostatic image forming unit.

The latent electrostatic image forming unit, for example, contains a charger which uniformly charges the surface of the photoconductor and an irradiator which exposes the surface of the latent image bearing member imagewise.

Charging may be performed, for example, by applying a voltage to the surface of the photoconductor using a charger.

The charger is not limited and may be selected accordingly. Examples of charger include known contact chargers equipped with conductive or semi-conductive roll, brush, film or rubber blade and non-contact chargers using corona discharges such as corotron or scorotron, etc.

Exposures may be performed by exposing the surface of the photoconductor imagewise using exposure machines, for example.

The exposure machine is not limited as long as it is capable of exposing the surface of photoconductor that has been charged by a charger to form an image as it is expected, and may be selected accordingly. Examples thereof include various exposure machines such as copy optical system, rod lens array system, laser optical system, and liquid crystal shutter optical system, etc.

A backlight system may be employed in the invention by which the photoconductor is exposed imagewise from the rear surface.

—Developing and Developing Unit—

Developing is a step by which a latent electrostatic image is developed using toner and/or developer of the invention to form a visible image.

The visible image may be formed, for example, by developing a latent electrostatic image using toner and/or developer, which may be performed by a developing unit.

The developing unit is not particularly limited as long as it is capable of developing an image by using toner and/or developer, for example, and may be selected from known developing unit accordingly. Examples thereof include those having a development apparatus containing toner and/or developer that can supply toner and/or developer to the latent electrostatic images by contact or with no contact. It is preferably a development apparatus equipped with a toner container.

The development apparatus may be of dry developing system or wet developing system and may also be for single or multiple colors. Preferred examples include one having mixer whereby toner and/or developer is charged by friction-stirring and rotatable magnet rollers.

In the development apparatus, the toner and the carrier may, for example, be mixed and stirred together. The toner is thereby charged by friction and forms a magnetic brush on the surface of the rotating magnet roller. Since the magnet roller is arranged near the latent electrostatic image bearing member (photoconductor), a part of the toner constructing the magnetic brush formed on the surface of the magnet roller is moved toward the surface of the latent electrostatic image bearing member (photoconductor) due to the force of electrical attraction. As a result, a latent electrostatic image is developed by the use of toner, and a visible toner image is formed on the surface of the latent electrostatic image bearing member (photoconductor).

The developer contained in the development apparatus is the developer of the invention containing the toner and it may be one-component or two-component developer. The toner contained in the developer is the toner of the invention.

—Transferring and Transfer Unit—

Transferring is a step that transfers the visible image to a recording medium. In a preferable aspect, the first transferring is performed using an intermediate transferring member by which the visible image is transferred to the intermediate transferring member, and the second transfer is performed wherein the visible image is transferred to the recording medium. In a more preferable aspect, toner of two or more colors and preferably of full-color and the configuration of which the first transferring is performed by transferring the visible image to the intermediate transferring member to form a compounded transfer image, and the second transferring is performed by transferring the compounded transfer image to the recording medium is employed.

Transferring of the visible image may be carried out, for example, by charging the latent electrostatic image bearing member (photoconductor) using a transferring charger, which can be performed by the transfer unit. In a preferable aspect, the transfer unit contains the first transfer unit which transfers the visible image to the intermediate transferring member to form a compounded transfer image, and the second transfer unit which transfers the compounded transfer image to the recording medium.

The intermediate transferring member is not limited and may be selected from known transferring members and preferred examples include transfer belts.

The transfer units of the first and the second transfer preferably contain an image-transfer unit which releases by charging the visible image formed on the latent electrostatic image bearing member (photoconductor) to the recording-medium side. There may be one, two or more of the transfer unit.

The image-transfer unit may be a corona transfer unit based on corona discharge, transfer belt, transfer roller, pressure transfer roller, or adhesion transfer unit.

The recording medium may be properly selected from recording media or recording paper known in the art.

—Fixing and Fixing Unit—

Fixing is a step that fixes the visible image transferred to the recording medium using a fixing unit. The fixing may be carried out using developer of each color transferred to the recording medium, or in one operation when the developers of each color have been laminated.

The fixing unit may be properly selected from heat and pressure units known in the art. Examples of heat and pressure unit include a combination of heat roller and pressure roller and a combination of heat roller, pressure roller and endless belt.

The heating temperature in the heat-pressure unit is preferably 80° C. to 200° C.

Further, an optical fixing unit known in the art may be used in addition to or in place of fixing and fixing unit depending on the application.

Charge-eliminating is a step that applies a discharge bias to the photoconductor to discharge it and may be performed by a charge-eliminating unit.

The charge-eliminating unit may be properly selected from charge-eliminating units known in the art as long as it is capable of applying a discharge bias to the photoconductor such as discharge lamps.

The cleaning is a step that removes the residual electrophotographic toner on the latent electrostatic image bearing member and it is favorably performed by a cleaning unit.

The cleaning unit is not particularly limited as long as it can remove the residual electrophotographic toner on the latent electrostatic image bearing member and may be selected from known cleaners such as magnetic brush cleaner, electrostatic brush cleaner, magnetic roller cleaner, blade cleaner, brush cleaner and web cleaner, etc.

Recycling is a step that recycles the electrophotographic toner removed in the cleaning to the developing, and may be performed by the use of recycling unit.

The recycling unit may be properly selected from transport units known in the art.

Controlling is a step that controls the respective steps, and may be carried out by the use of control unit.

The control unit may be properly selected depending on the application, as long as it is capable of controlling the entire units; the control unit may be equipped with instruments such as sequencers or computers, etc.

<Development Apparatus Composition>

A roller coated with elastic rubber layer is used as a developing roller and a surface coat layer made of material which is likely to be charged oppositely of toner is disposed on the surface of the developing roller. The elastic rubber layer is assigned of 60 degrees or less of hardness by JIS-A standard in order to prevent toner degradation caused by pressure concentration at a contact portion with developer layer thickness control member. The surface roughness is set at Ra of 0.31 μm to 2.0 μm and required amount of toner is retained on the surface. Moreover, since developing bias is applied to the developing roller to form an electrical field with the photoconductor, the resistance value of the elastic rubber layer is set at $10^3\Omega$ to $10^{10}\Omega$. The developing roller rotates in a clockwise direction and feeds the toner retained on the surface to a position facing the developer layer thickness control member and the photoconductor.

The developer layer thickness control member is positioned below the contact position of supplying roller and the developing roller. The free nearside of the developer layer thickness control member is brought into contact with the surface of developing roller by using metallic plate spring material such as SUS and phosphor bronze with a suppress strength of 10 N/m to 40 N/m and the toner passing through the suppressed spot is made in the form of thin layer and at the same time, charged with frictional electrification. Moreover, a control bias of the value which is offset in the same direction of the charge polarity of toner corresponding to developing bias is applied to the developer layer thickness control member to assist frictional electrification.

The rubber elastic body composing the surface of the developing roller is not particularly limited and examples include styrene-butadiene copolymer rubber, acrylonitrile-butadiene copolymer rubber, acrylic rubber, epichlorohydrin rubber, urethane rubber, silicone rubber and a blend of two or more of these materials. Of these, a blend rubber of epichlorohydrin rubber and acrylonitrile-butadiene copolymer rubber is preferably used.

The developing roller of the present invention is manufactured by coating periphery of conductive shaft with a rubber elastic body, for example. The conductive shaft is composed of metals such as stainless, for example.

<Charging Member Composition of Latent Electrostatic Image Bearing Member>

The charging member of the present invention has a shaft 3, conductive layer 5 disposed on the shaft 3 and a surface layer 6 which covers the conductive layer 5 as shown in FIG. 1 and is formed in a cylindrical form. The voltage applied to the shaft 3 by a voltage source 7 is applied to the latent image bearing member 1 through conductive layer 5 and surface layer 6 to charge the surface of the latent image bearing member 1.

The shaft 3 of the charging member 2 is positioned along the longer direction of the latent image bearing member 1 (in parallel with the axis of the latent image bearing member 1) and the charging member 2 is entirely pressed against the latent image bearing member 1 with a predefined suppress strength. Thereby each portion of the surface of the latent image bearing member 1 and the charging member 2 is brought into contact along each longer direction to form a contact nip with a predetermined width. The latent image bearing member 1 is rotary activated by an activating unit not shown in figures and the charging member 2 is constructed so as to be rotated along with the latent image bearing member 1.

In FIG. 1, exposing unit, developing unit, transfer unit and cleaning unit are omitted.

The charging of the latent image bearing member 1 by the voltage source 7 is performed through vicinity of the above contact nip. The surface of the charging member 2 and the charged region (corresponds to the length of the charging member 2) of the surface of the latent image bearing member 1 are brought into contact evenly through the contact nip to make charged region of the surface of the latent image bearing member 1 uniform.

The conductive layer 5 of the charging member 2 is a nonmetal (a conductive vulcanized rubber in this case) and a material low in hardness can be favorably used in order to stabilize the contact state with the latent image bearing member 1. For example, resins such as polyurethane, polyether and polyvinyl alcohol and rubbers such as hydrin rubber, EPDM and NBR may be used. Examples of conductive materials include carbon black, graphite, titanic oxide and zinc oxide.

The materials having a moderate resistance value ($10^2\Omega$ to $10^{10}\Omega$) such as polyurethane-silicone acrylic polymer containing acetylene black, for example are used for the surface layer 6.

Examples of resins include nylon, polyamide, polyimide, polyurethane, polyester, silicone, Tefron™, polyacetylene, polypyrrole, polythiophene, polycarbonate and polyvinyl and it is preferable to use fluorine resin for improving water contact angle.

Examples of fluorine resins include polyvinylidene-fluoride, polyethylene-fluoride, vinylidene fluoride-tetrafluoroethylene copolymer and vinylidene fluoride-tetrafluoroethylene-propylene hexafluoride copolymer.

Furthermore, conductive materials such as carbon black, graphite, titanic oxide, zinc oxide, tin oxide and iron oxide may be added accordingly for the purpose of adjusting resistance to moderate value.

Figure 2:
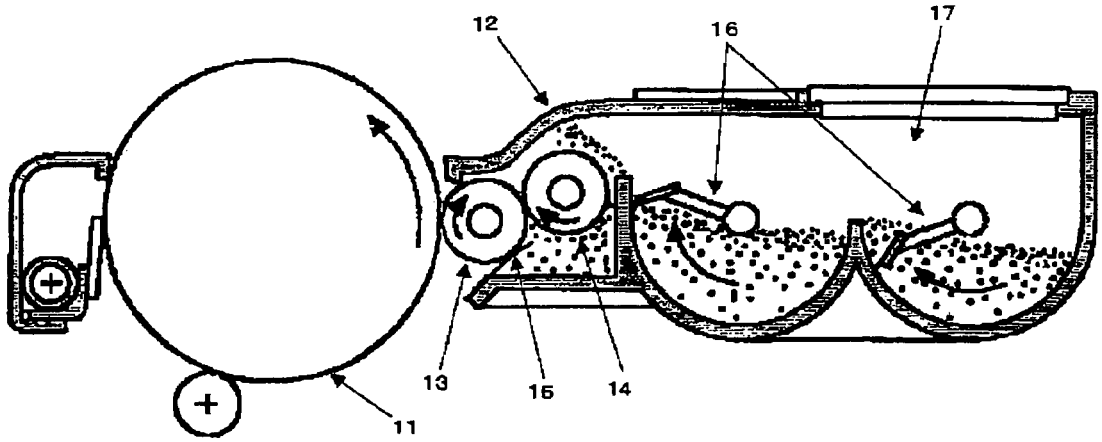
FIG. 2 is a diagram showing an example of the image forming method of the present invention.

An exemplary image forming method of the present invention is shown in FIG. 2. In this image forming method, a photoconductor 11 is rotated from downward to upward in an arrow direction. The developing roller 13 of the development apparatus 12 is activated as shown by the arrow while being in contact with the photoconductor 11 or retaining a gap of approximately 0.1 to 0.3 from the photoconductor 11.

The developing roller 13 is composed of metal conductive body such as aluminum and stainless of which appropriate roughness of the surface is retained by sandblast treatment. A toner supplying roller 14 is positioned around the developing roller 13 and a rubber plate (urethane rubber or silicone rubber, for example) is attached to the plate spring material or a control blade (developer layer thickness control blade) 15 made of a metal such as SUS is positioned.

Furthermore, a toner feeding shaft 16 is disposed in a retention room 17 in which a toner is retained as rotatable for feeding toner to the toner supplying roller 14.

Figure 3:
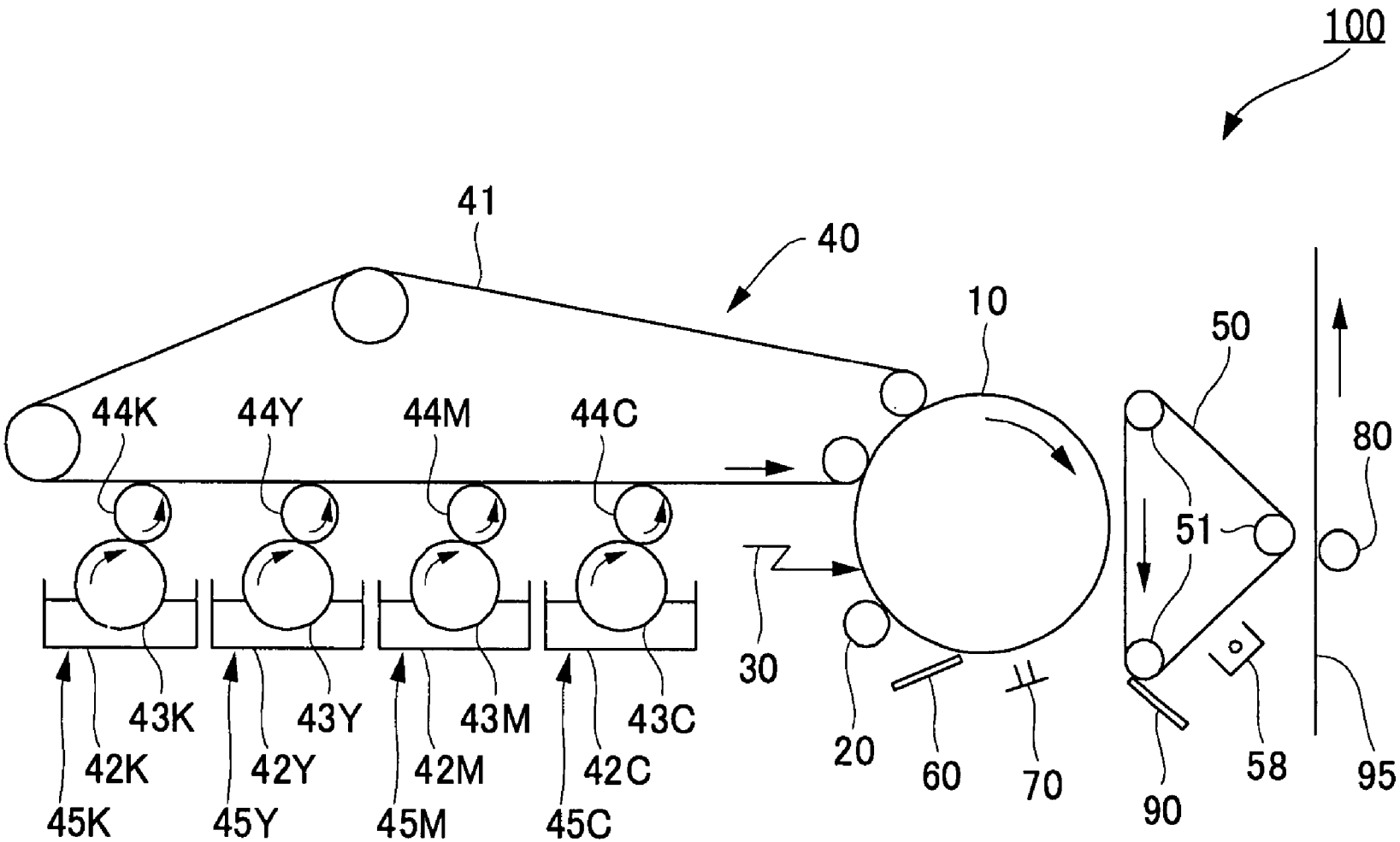
FIG. 3 is a schematic diagram showing an example of the image forming method of the present invention performed by the image forming apparatus of the present invention.

An aspect of the operation of the image forming process performed by the image forming apparatus of the invention is described referring to FIG. 3. The image forming apparatus 100 shown in FIG. 3 is equipped with the photoconductor drum 10 (hereafter referred to as "photoconductor 10") as a latent electrostatic image bearing member, the charge roller 20 as a charging unit, the exposure apparatus 30 as an exposure unit, the developing unit 40 as a developing unit, the intermediate transferring member 50, the cleaning unit 60 having a cleaning blade as a cleaning unit and the discharge lamp 70 as a discharging unit.

The intermediate transferring member 50 is an endless belt that is being extended by the three roller 51 placed inside the belt and designed to be moveable in arrow direction. A part of three roller 51 function as a transfer bias roller that can imprint a specified transfer bias, the primary transfer bias, to the intermediate transferring member 50. The cleaning unit 90 with a cleaning blade is placed near the intermediate transferring member 50, and the transfer roller 80, as a transfer unit which can imprint the transfer bias for transferring the developed image, toner image (second transferring), onto the transfer paper 95 as the final transfer material, is placed face to face with the cleaning unit 90. In the surrounding area of the intermediate transferring member 50, the corona charger 58, for charging toner image on the intermediate transferring member 50, is placed between contact area of the photoconductor 10 and the intermediate transferring member 50 and contact area of the intermediate transferring member 50 and the transfer paper 95 in the rotating direction of the intermediate transferring member 50.

The development apparatus 40 is constructed with developing belt 41 as a developer bearing member, black developing unit 45K, yellow developing unit 45Y, magenta developing unit 45M and cyan developing unit 45C that are juxtapositioned in the surrounding area of developing belt 41. The black developing unit 45K is equipped with developer container 42K, developer feeding roller 43K and developing roller 44K whereas yellow developing unit 45Y is equipped with developer container 42Y, developer feeding roller 43Y and developing roller 44Y. The magenta developing unit 45M is equipped with developer container 42M, developer feeding roller 43M and developing roller 44M whereas the cyan developing unit 45C is equipped with developer container 42C developer feeding roller 43C and developing roller 44C. The developing belt 41 is an endless belt and is extended between a number of belt rollers as rotatable and the part of developing belt 41 is in contact with the photoconductor 10.

For example, the charge roller 20 charges the photoconductor drum 10 evenly in the image forming apparatus 100 as shown in FIG. 3. The exposure apparatus 30 exposes imagewise on the photoconductor drum 10 and forms a latent electrostatic image. The latent electrostatic image formed on the photoconductor drum 10 is then developed with the toner fed from the developing unit 40 to form a visible image (toner image). The visible image (toner image) is then transferred onto the intermediate transferring member 50 by the voltage applied from the roller 51 as the primary transferring and it is further transferred onto the transfer paper 95 as the secondary transferring. As a result, a transfer image is formed on the transfer paper 95. The residual toner on the photoconductor 10 is removed by the cleaning unit 60 and the charge built up over the photoconductor 10 is temporarily removed by the discharge lamp 70.

Figure 4:
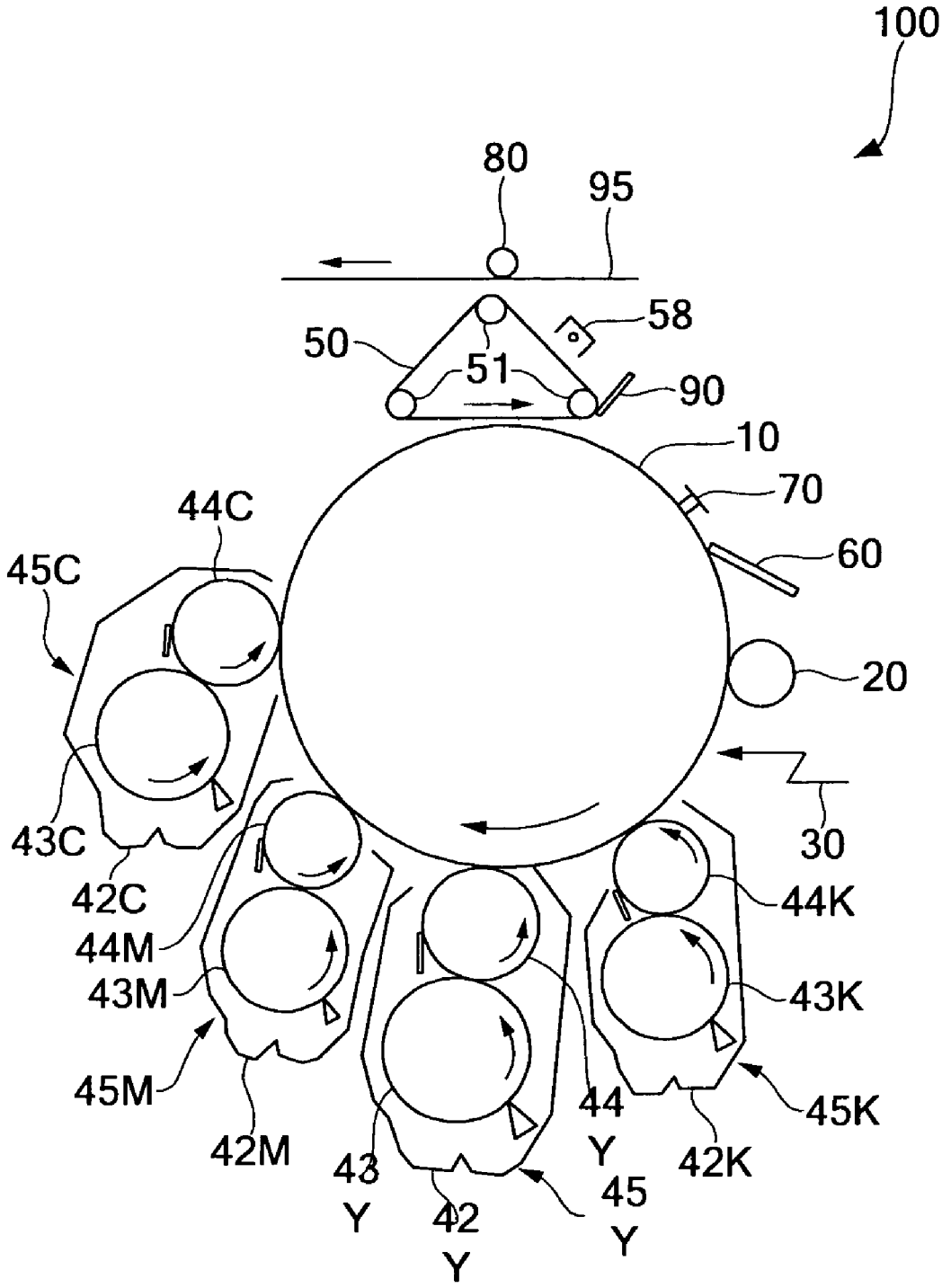
FIG. 4 is a schematic diagram showing another example of the image forming method of the present invention performed by the image forming apparatus of the present invention.

The other aspect of the operation of image forming processes of the invention by image forming apparatuses of the invention is described referring to FIG. 4. The image forming apparatus 100 as shown in FIG. 4 has the same lineups and effects as the image forming apparatus 100 shown in FIG. 3 except for the developing belt 41 is not equipped and the black developing unit 45K, the yellow developing unit 45Y, the magenta developing unit 45M and the cyan developing unit 45C are placed in the surrounding area directly facing the photoconductor 10. The symbols used in FIG. 4 correspond to the symbols used in FIG. 3.

Figure 5:
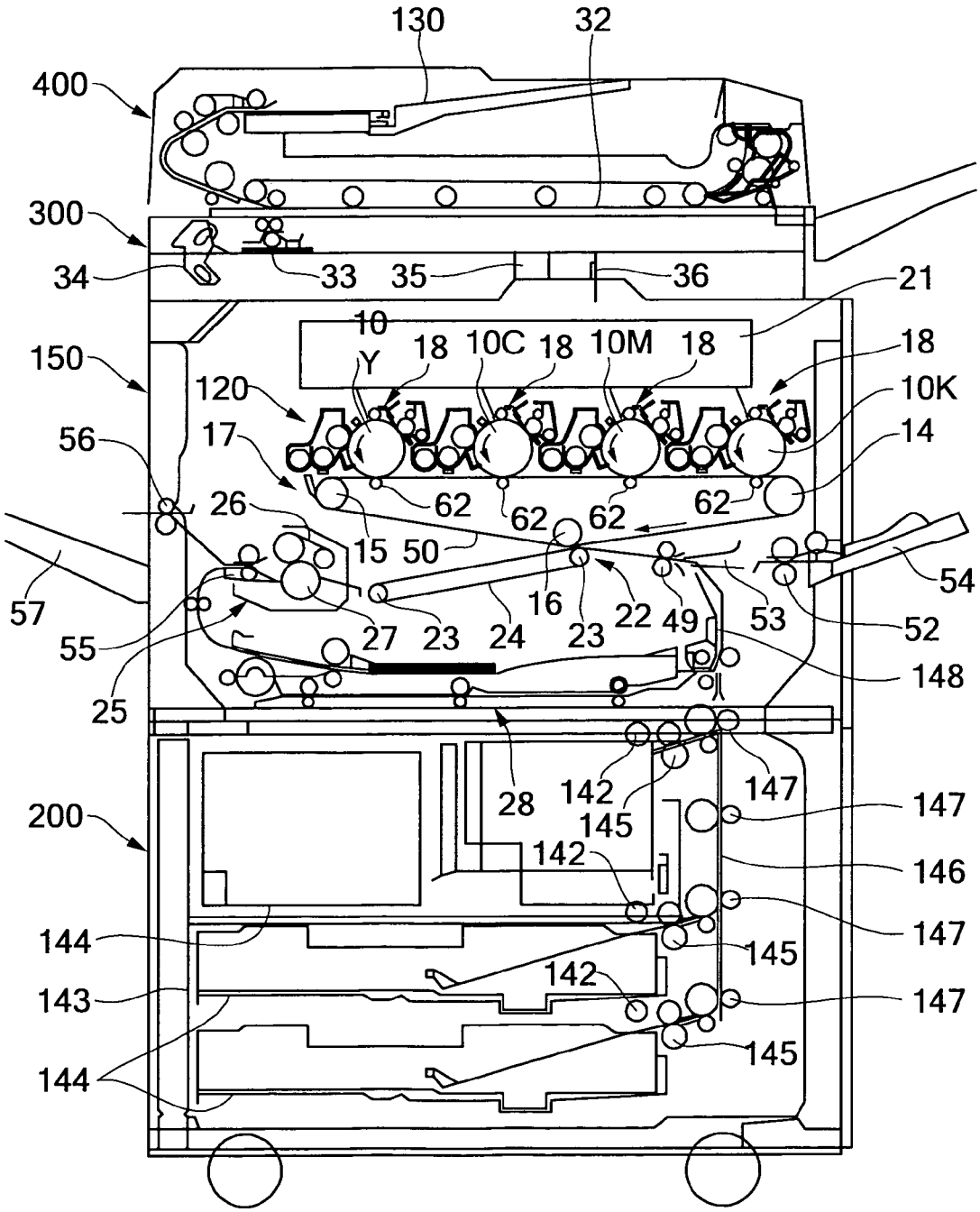
FIG. 5 is a schematic diagram showing an example of the image forming method of the present invention performed by the image forming apparatus (tandem color image forming apparatus) of the present invention.

The other aspect of the operation of image forming processes of the invention by image forming apparatuses of the invention is described referring to FIG. 5. The tandem image forming apparatus 100 as shown in FIG. 5 is a tandem color image forming apparatus. The tandem image forming apparatus 100 is equipped with the copier main body 150, the feeding paper table 200, the scanner 300 and the automatic document feeder (ADF) 400.

The intermediate transferring member 50 in a form of an endless belt is placed in the center part of the copier main body 150. The intermediate transferring member 50 is extended between the support roller 14, 15 and 16 as rotatable in the clockwise direction as shown in FIG. 5. The intermediate transferring member cleaning unit 17 is placed near the support roller 15 in order to remove the residual toner on the intermediate transferring member 50. The tandem developing unit 120, in which four image forming unit 18, yellow, cyan, magenta and black, are positioned in line along the transport direction in the intermediate transferring member 50, which is being extended between the support roller 14 and 15. The exposure unit 21 is placed near the tandem developing unit 120. The secondary transfer unit 22 is placed on the opposite side where tandem developing unit 120 is placed in the intermediate transferring member 50. The secondary transfer belt 24, an endless belt, is extended between a pair of the roller 23 and the transfer paper transported on the secondary transfer belt 24 and the intermediate transferring member 50 are accessible to each other in the secondary transfer unit 22. The fixing unit 25 is placed near the secondary transfer unit 22. The fixing unit 25 is equipped with a fixing belt 26 which is an endless belt and a pressure roller 27 which is positioned by being pressed by the fixing belt 26.

The sheet inversion unit 28 is placed near the secondary transfer unit 22 and the fixing unit 25 in the tandem image forming apparatus 100, in order to invert the transfer paper to form images on both sides of the transfer paper.

The full-color image formation, color copy, using the tandem developing unit 120 will be explained. First, a document is set on the document table 130 of the automatic document feeder (ADF) 400 or the automatic document feeder 400 is opened and a document is set on the contact glass 32 of the scanner 300 and the automatic document feeder 400 is closed.

By pushing the start switch (not shown in figures), the scanner 300 is activated after the document was transported and moved onto the contact glass 32 when the document was set on the automatic document feeder 400, or the scanner 300 is activated right after, when the document was set onto the contact glass 32, and the first carrier 33 and the second carrier 34 will start running. The light from the light source is irradiated from the first carrier 33 simultaneously with the light reflected from the document surface is reflected by the mirror of second carrier 34. Then the scanning sensor 36 receives the light via the imaging lens 35 and the color copy (color image) is scanned to provide image information of black, yellow, magenta and cyan.

Figure 6:
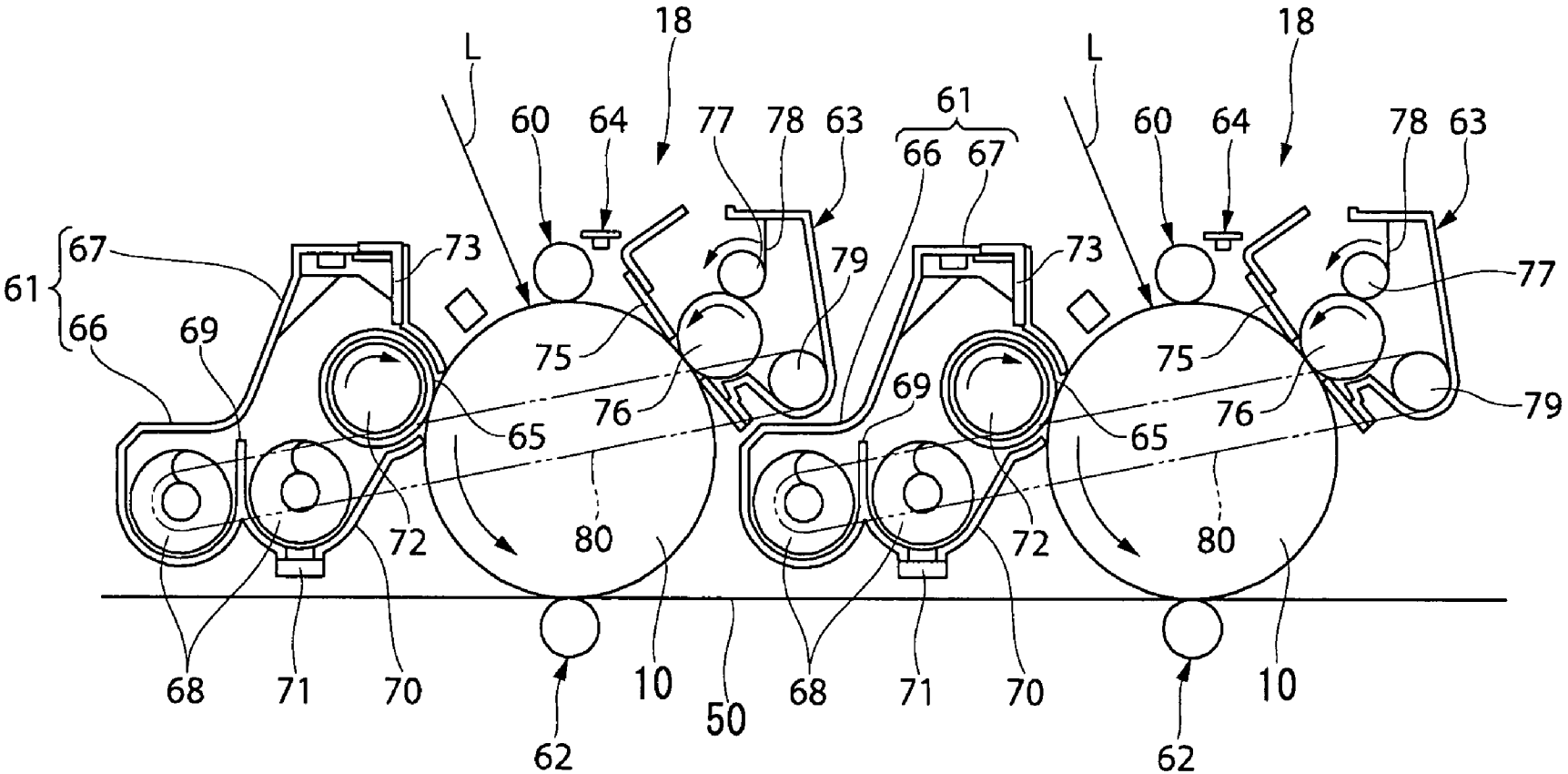
FIG. 6 is a partially enlarged schematic diagram showing the image forming apparatus of FIG. 5.

Each image information for black, yellow, magenta and cyan is transmitted to each image forming unit 18: black image forming unit, yellow image forming unit, magenta image forming unit and cyan image forming unit, of the tandem developing unit 120 and each toner image of black, yellow, magenta and cyan is formed in each image forming unit. The image forming unit 18: black image forming unit, yellow image forming unit, magenta image forming unit and cyan image forming unit of the tandem image forming apparatus 120 as shown in FIG. 6 is equipped with the photoconductor 10: photoconductor 10K for black, photoconductor 10Y for yellow, photoconductor 10M for magenta and photoconductor 10C for cyan, the charger 60 that charges photoconductor evenly, an exposing unit by which the photoconductor is exposed imagewise corresponding to each color images based on each color image information as indicated by L in FIG. 6 to form a latent electrostatic image corresponding to each color image on the photoconductor, the developing unit 61 by which the latent electrostatic image is developed using each color toner: black toner, yellow toner, magenta toner and cyan toner to form toner images, the charge-transfer unit 62 by which the toner image is transferred onto the intermediate transferring member 50, the photoconductor cleaning unit 63 and the discharger 64. The image forming unit 18 is able to form each single-colored image: black, yellow, magenta and cyan images, based on each color image information. These formed images: black image formed on the photoconductor 10K for black, yellow image formed on the photoconductor 10Y for yellow, magenta image formed on the photoconductor 10M for magenta and cyan image formed on the photoconductor 10C for cyan, are transferred sequentially onto the intermediate transferring member 50 which is being rotationally transported by the support rollers 14, 15 and 16 (the primary transferring). And the black, yellow, magenta and cyan images are overlapped to form a synthesized color image, a color transfer image.

In the feeding table 200, one of the feeding roller 142 is selectively rotated and sheets (recording paper) are rendered out from one of the feeding cassettes equipped with multiple-stage in the paper bank 143 and sent out to feeding path 146 after being separated one by one by the separation roller 145. The sheets are then transported to the feeding path 148 in the copier main body 150 by the transport roller 147 and are stopped running down to the resist roller 49. Alternatively, sheets (recording paper) on the manual paper tray 54 are rendered out by the rotating feeding roller 142, inserted into the manual feeding path 53 after being separated one by one by the separation roller 145 and stopped by running down to the resist roller 49. Generally, the resist roller 49 is used being grounded; however, it is also usable while bias is imposed for the sheet powder removal.

The resist roller 49 is rotated on the systhesized color image (color transfer image) on the intermediate transferring member 50 in a good timing, and a sheet (recording paper) is sent out between the intermediate transferring member 50 and the secondary transfer unit 22. The color image is then formed on the sheet (recording paper) by transferring (secondary transferring) the synthesized color image (color transfer image) by the secondary transfer unit 22. The residual toner on the intermediate transferring member 50 after the image transfer is cleaned by the intermediate transferring member cleaning unit 17.

The sheet (recording paper) on which the color image is transferred and formed is taken out by the secondary transfer unit 22 and sent out to the fixing unit 25 in order to fix the synthesized color image (color transfer image) onto the sheet (recording paper) under the thermal pressure. Triggered by the switch claw 55, the sheet (recording paper) is discharged by the discharge roller 56 and stacked on the discharge tray 57. Alternatively, triggered by the switch 55, the sheet is inverted by the sheet inversion unit 28 and led to the transfer position again. After recording an image on the reverse side, the sheet is then discharged by the discharge roller 56 and stacked on the discharge tray 57.

(Process Cartridge)

The process cartridge of the present invention at least contains a latent electrostatic image bearing member for bearing a latent electrostatic image and a developing unit for developing the latent electrostatic image on the latent electrostatic image bearing member using a developer and further contains other units selected accordingly.

The developing unit at least contains a developer container for storing the toner and/or developer of the present invention and a developer carrier for carrying and feeding the toner and/or developer stored in the developer container and may further contain a layer thickness control member for controlling the thickness of carried toner layer.

The process cartridge of the present invention may be detachably mounted on a variety of electrophotographic apparatuses and is preferably detachably mounted on the electrophotographic apparatus of the present invention, which will be described later.

Figure 7:
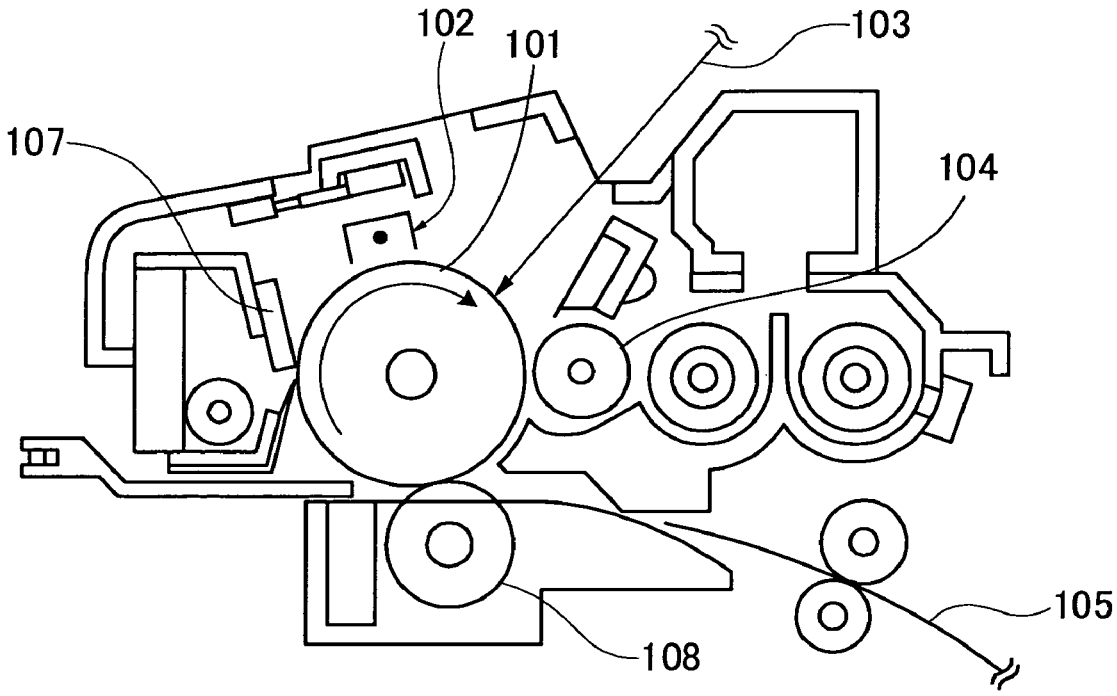
FIG. 7 is a schematic diagram showing an exemplary process cartridge of the present invention.

The process cartridge contains a built-in photoconductor 101 as shown in FIG. 7 and is equipped with at least one of charging unit 102, developing unit 104, transfer unit 108, cleaning unit 107 and charge-eliminating unit (not shown). The process cartridge is equipment (part) mounted onto the image forming apparatus main body as detachable.

In the image forming process by process cartridge as shown in FIG. 7, a latent electrostatic image which corresponds to the exposed image is formed on the surface of the photoconductor 101 which is rotated in the arrow direction by charging using the charging unit 102 and the exposure 103 of the exposing unit (not shown). The latent electrostatic image is toner developed by means of the developing unit 104, the toner image is then transferred to a recording medium 105 by means of the transfer unit 108 and printed out. And the photoconductor surface after image transfer is cleaned by means of the cleaning unit 107 and further discharged by means of charge-eliminating unit (not shown) and these operations are again repeated.

EXAMPLES

Herein below, with referring to Examples and Comparative Examples, the invention is explained in detail and the following Examples and Comparative Examples should not be construed as limiting the scope of this invention.

First, a manufacturing method of toner particles will be described.

<Preparation of First Binder Resin>

First, 600 g of styrene, 110 g of butyl acrylate and 30 g of acrylic acid as vinyl monomer and 30 g of dicumyl peroxide as polymerization initiator were put in a dropping funnel. Of polyester monomers, 1,230 g of polyoxypropylene(2,2)-2,2-bis(4-hydroxyphenyl)propane, 290 g of polyoxyethylene(2,2)-2,2-bis(4-hydroxyphenyl)propane, 250 g of isododecenylsuccinic anhydride, 310 g of terephthalic acid and 180 g of anhydrous 1,2,4-benzenetricarboxylic acid as polyol, 7 g of dibutyltin oxide as esterification catalyst and 340 g (11.0 parts by mass relative to 100 parts by mass of feed monomer) of paraffin wax (melting point 73.3° C., The endothermic peak during heating measured by a differential scanning calorimeter has a half width of 4° C.) as a wax were put in a 5 L four-neck flask equipped with thermometer, stainless-steel agitator, falling condenser and nitrogen introducing tube and a compound liquid of the vinyl monomer resin and polymerization initiator was allowed to drip from the dropping funnel for 1 hour while stirring at 160° C. in a nitrogen atmosphere inside the mantle heater. After maturing addition condensation reaction for 2 hours while still retaining the temperature of 160° C., condensation polymerization reaction was performed by heating at 230° C. The polymerization degree was tracked by softening point measured by using a constant-load extrusion, tubulus rheometer and the reaction was terminated at a desired softening point to obtain a resin H1. The softening point of the resin was 130° C.

<Preparation of Second Binder Resin>

First, 2,210 g of polyoxypropylene (2,2)-2,2-bis(4-hydroxyphenyl)propane, 850 g of terephthalic acid and 120 g of anhydrous 1,2,4-benzenetricarboxylic acid as polyol, and 0.5 g of dibutyltin oxide as esterification catalyst were put in a 5 L four-neck flask equipped with thermometer, stainless-steel agitator, falling condenser and nitrogen introducing tube and condensation polymerization reaction was performed by heating at 230° C. in a nitrogen atmosphere inside the mantle heater. The polymerization degree was tracked by a softening point measured by using a constant-load extrusion, tubulus rheometer and the reaction was terminated at a desired softening point to obtain a resin L1. The softening point of the resin was 115° C.

<Preparation of Toner Particle A>

A masterbatch containing approximately 4 parts by mass of C.I. Pigment Red 57-1 was adequately mixed with 100 parts by mass (includes mass of internally added wax) of a binder resin which contains a first binder resin and a second binder resin in a ratio of 7:3 using a Henschel mixer. It was then melt-kneaded using a two-axis extrusion kneader (PCM-30 manufactured by Ikegai Ltd.) of which exhaust portion is removed and the obtained product was rolled into a thickness of 2 mm using a cooling press roller and it was roughly pulverized by a feather mill after cooling on a cooling belt. And then it was pulverized to an average particle diameter of 10 μm to 12 μm using a mechanical pulverizer (KTM manufactured by Kawasaki Heavy Industries, Ltd.) and further pulverized while being subjected to coarse classification using a jet pulverizer (IDS manufactured by Nippon Pneumatic Mfg. Co., Ltd.) and fine classification using a rotor classifier (T Plex classifier, 100ATP manufactured by Hosokawa Micron Corporation) to obtain a color toner particle A.

The particle diameter of the toner particle A was 7.8 μm.

<Preparation of Toner Particle B>

A masterbatch containing approximately 4.5 parts by mass of C. I. Pigment Red 57-1 was adequately mixed with 100 parts by mass (includes mass of internally added wax) of a binder resin which contains a first binder resin and a second binder resin in a ratio of 7:3 using a Henschel mixer. It was then melt-kneaded using a two-axis extrusion kneader (PCM-30 manufactured by Ikegai Ltd.) of which exhaust portion is removed and the obtained product was rolled into a thickness of 2 mm using a cooling press roller and it was roughly pulverized by a feather mill after cooling on a cooling belt. And then it was pulverized to an average particle diameter of 10 μm to 12 μm using a mechanical pulverizer (KTM manufactured by Kawasaki Heavy Industries, Ltd.) and further pulverized while being subjected to coarse classification using a jet pulverizer (IDS manufactured by Nippon Pneumatic Mfg. Co., Ltd.) and fine classification using a rotor classifier (T Plex classifier, 100ATP manufactured by Hosokawa Micron Corporation) to obtain a color toner particle B.

The average particle diameter of the toner particle B was 7.8 μm.

<Preparation of Toner Particle C>

First, 50 parts by mass of C. I. Pigment blue 15:3 as cyan pigment, 10 parts by mass of dodecyl sodium sulfate and 200 parts by mass of deionized water were dispersed using a sand grinder mill to obtain a colorant dispersion liquid with a volume average particle diameter of 170 nm.

A solution, in which 4.05 parts by mass of dodecyl sodium sulfate was dissolved in 2,500 parts by mass of deionized water, was put in a separable flask of 5,000 ml equipped with agitator, temperature sensor, condenser tube and nitrogen introducing apparatus and heated to 80° C. while being agitated at an agitating speed of 230 rpm under a nitrogen flow. Next, after a solution, into which 9.62 parts of potassium persulfate was dissolved in 200 parts by mass of deionized water, was added, a mixture of 568 parts of styrene, 164 parts by mass of acrylic acid n-butyl, 68 parts of methacrylic acid and 16.51 parts of n-octyl mercaptan was allowed to drip for 1 and half hour and polymerization (first polymerization) was performed by heat mixing at 80° C. for 2 hours to prepare a latex (1H). The mass average particle diameter of the latex (1H) was 68 nm.

Further, 123.81 parts by mass of styrene, 39.51 parts by mass of acrylic acid n-butyl, 12.29 parts by mass of methacrylic acid, 0.72 parts by mass of n-octyl mercaptan, 475 parts by mass of ester wax AC ($CH_2$—O—CO—$(CH_2)_2$O—$CH_3$) and 10 parts by mass of bisphenol compound 1 were put in a flask equipped with agitator and heat-melted at 80° C. to prepare a monomer solution.

A solution, in which 0.6 parts by mass of surfactant expressed by the following Chemical Formula (1) was dissolved in 2,700 parts by mass of deionized water, was heated at 98° C. and after 32 parts by mass assuming solid content conversion of latex (1H) was added, the monomer solution was added and mix dispersed for 8 hours using a mechanical disperser having a cycling pathway, Clearmix manufactured by M Technique Co., Ltd. to prepare a dispersion liquid.

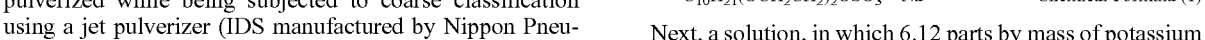

$$C_{10}H_{21}(OCH_2CH_2)_2OSO_3—Na^+ \qquad \text{Chemical Formula (1)}$$

Next, a solution, in which 6.12 parts by mass of potassium persulfate was dissolved in 250 parts by mass of deionized water, was added to the dispersion liquid and polymerization (second polymerization) was performed by heat mixing at 82° C. for 12 hours to obtain a latex (1HM).

After a solution in which 8.8 parts by mass of potassium persulfate was dissolved in 350 parts by mass of deionized water was added to the latex (1HM), a mixture of 350 parts by mass of styrene, 95 parts by mass of acrylic acid n-butyl, 5 parts by mass of methacrylic acid and 1 mol % of monomer, n-octyl mercaptan was allowed to drip at 82° C. for 1 hour. After dripping was finished, polymerization (third polymerization) was performed by heat mixing at 82° C. for 2 hours and it was then cooled to 28° C. to obtain latex (1HML).

Next, 420 parts by mass assuming solid content conversion of latex (1HML), 900 parts by mass of deionized water and 150 parts by mass of colorant dispersion liquid were put in a reaction container (four-neck flask), which is equipped with temperature sensor, condenser tube, nitrogen introducing apparatus and agitator and were agitated. After the temperature inside the container was adjusted to 30° C., an aqueous solution of 5 N sodium hydroxide was added to adjust pH to 8 to 10.

Next, a solution, in which 65 parts of magnesium chloride hexahydrate was dissolved in 1,000 parts by mass of deionized water, was added while agitating for 10 minutes. After leaving for 3 minutes, it was heated to 92° C. to generate agglomerated particle. The particle diameter of the agglomerated particle was measured using a Coulter counter TA-II manufactured by Beckman Coulter, Inc. in this state, and particle growth was terminated by adding a solution in which 80.4 parts by mass of potassium chloride was dissolved in 1,000 parts by mass of deionized water at a point where the number average particle diameter was 6.1 μm. Furthermore, particle fusion and phase separation of crystalline material were continued by heat mixing at 94° C. as a maturing treatment. The form of fused particles was measured by means of FPIA-2000 manufactured by Sysmex Corporation in this state and agitation was stopped by cooling to 30° C. at a point where the average degree of circularity was 0.960. The generated fused particles were then filtered, washed repeatedly with deionized water at 45° C. and dried with hot air at 40° C. to obtain a toner particle C. When average particle diameter and average degree of circularity of toner particle B were measured again, they were 7.1 μm and 0.958 respectively.

<Manufacture of Carrier>

A solution containing 500 g of silicone resin liquid (SR-2411 manufactured by Dow Corning Toray Co., Ltd., solid content: 20% by mass) and 1,450 g of toluene was sprayed in a heating condition at 80° C. over 5 kg of Cu—Zn ferrite of 45 μm particle diameter which was being flowed by a fluidized bed coating apparatus. It was then baked at 210° C. for 2 hours to obtain a carrier coated with silicone resin.

(Preparation of Magnesium Silicate Compound)

A slurry of $Mg(OH)_2$ powder and $SiO_2$ powder (average primary particle diameter of 0.021 μm) were weighed so that the molar ratio, $MgO:SiO_2$ becomes 2:1 and a slurry of 150 L with MgO density of 71.5 g/L and $SiO_2$ density of 53.3 g/L was prepared. And a wet pulverization was performed with a condition of media filling ratio of 80%, a solution sending density of 4.0 L/min and 3 slurry pass, using alumina silica beads of 0.8 mm diameter as media and by means of sand grinder mill. The slurry was then spray dried using a spray drier and baked in an electric furnace at 1,100° C. in the atmosphere for 30 minutes. The baked product was then made into slurry of 300 g/L and 50 L of the slurry was subjected to wet pulverization with a condition of media filling ratio of 80%, a solution sending density of 5.6 L/min and 2 slurry pass, using alumina silica beads of 0.8 mm diameter as media and by means of a sand grinder mill. The slurry was then spray dried using a spray drier and was subjected to pulverization by means of a sand mill to obtain inorganic oxide 1 (forsterite) as shown in Table 2.

Moreover, an inorganic oxide 2 (forsterite) as shown in Table 2 was obtained by similar method except for wet pulverization after baking was performed with one slurry pass.

Next, an inorganic oxide 3 (enstatite) as shown in Table 2 was obtained by similar method except for using a slurry of 150 L with MgO density of 35.8 g/L and $SiO_2$ density of 53.3 g/L weighed and prepared so as to have a molar ratio, $MgO:SiO_2$ of 1:1.

The properties of the obtained magnesium silicate compounds are shown in Table 2.

Example 1

0.4 parts by mass of inorganic oxide, forsterite (first inorganic fine particle) as shown in Table 1 and 1 part by mass of Silica RX200 (second inorganic fine particle) were added to 100 parts by mass of colored resin particle A and mixed by means of a Henschel mixer at a peripheral velocity of 40 m/sec. for 60 seconds to obtain a magenta toner 1.

2,000 sheets of a specific print pattern at a printing ratio of 6% were repeatedly copied under N/N environment (23° C., 45%), using the above magenta toner as single component developer and an image forming apparatus (IPSiO CX2500 manufactured by Ricoh Company, Ltd.). The condition of developing roller in the development apparatus, copied image and filming and scratch on the photoconductor were visually observed and evaluated. The results are shown in FIG. 1.

The evaluation standard is as follow.

A: good

B: poses no problem for practical use

C: no good for practical use

Examples 2 to 9 and Comparative Examples 1 to 3

Each magenta toner 2 to 12 of Examples 2 to 9 and Comparative Examples 1 to 3 was obtained as similar to Example 1 except for using external additives as shown in Table 1. The print pattern was evaluated using each magenta toner as similar to Example 1.

Meanwhile, forsterite itself which is used in Examples has been known as a raw material for manufacturing ceramics as disclosed in JP-A No. 2003-327470, for example.

Example 10

<Preparation of Toner Particle>

1.5 parts by mass of inorganic oxide 1, forsterite (first inorganic fine particle) as shown in Table 3 and an external additive 1 as shown in Table 3 were added to 100 parts by mass of the toner particle B and mixed by means of a Henschel mixer at a peripheral velocity of 40 m/sec. for 60 seconds to obtain a toner of Example 10.

The above toner was mixed with the carrier and set in a full-color copier (PRETER550 manufactured by Ricoh Company, Ltd.) as two-component developer. 200,000 sheets of a color image (5% printing image) were repeatedly printed under low-temperature, low-humidity environment (temperature of 10° C. and relative humidity of 15%) and high-temperature, high-humidity environment (temperature of 30° C. and relative humidity of 80%) on a mode which pauses for 30 minutes every 1,000 sheets of repeated printing and the following evaluations were conducted.

The evaluation results are shown in Table 3.

The evaluation standard in Table 3 is as follow.

A: excellent

B: good

C: poses no problem for practical use

D: no good for practical use

The method of evaluation is as follow.

(Image Density and Following Ability)

The image density of solid parts after repeated printing was measured by means of X-Rite 939 and the difference in the image density of the same portion, from 5 cm from the tip of the paper to 5 cm from the end, between initial image and the image after 200,000 times of printing was evaluated by three stages.

(Background Smear)

The ΔE of background smear toner was obtained by tape transfer method. The tape transfer method is a method in which a mending tape manufactured by Sumitomo 3M Limited is attached to the existing toner on the photoconductor to transfer fog toner to the tape and the mending tape and a mending tape before being attached are attached on a white paper respectively. And the reflective density of these tapes are measured by means of X-Rite 939 and the reflective density (ΔE) of fog is obtained by subtracting the reflective density of the tape from these measured values (C*).

Examples 11 to 19 and Comparative Examples 4 to 6

Each magenta toner 2 to 12 of Examples 11 to 19 and Comparative Examples 4 to 6 was obtained as similar to Example 10 except for using toner particles, inorganic fine particle and external additives as shown in Table 3. Each print pattern was evaluated using these magenta toners as similar to Example 10. The results are shown in Table 3.

<Method of Measurement and Evaluation>

The measurement method of properties of used materials and evaluation method of obtained samples will be described.

—Toner Particle Diameter—

The measurement method of particle size distribution of the toner particles will be explained. Examples of the measuring equipment for particle size distribution of the toner particles by Coulter counter method include Coulter counter TA-II and Coulter multisizer II (both of which are manufactured by Beckman Coulter, Inc.).

The measurement method will be described below.

First, 0.1 ml to 5 ml of a surfactant (preferably alkylbenzene sulfonate) is added to 100 ml to 150 ml of electrolytic solution as dispersant. The electrolytic solution is a prepared NaCl solution of approximately 1% using primary sodium chloride and examples include ISOTON-II manufactured by Beckman Coulter, Inc. The measurement sample is further added in a solid content of 2 mg to 20 mg. The electrolytic solution in which the sample is suspended is subject to dispersion treatment for approximately 1 minute to 3 minutes using an ultrasonic disperser and the volume and number of toner particle or toner are measured by means of the measuring equipment, employing an aperture of 100 μm to calculate volume and number distributions. The volume average particle diameter (Dv) and number average particle diameter (Dp) can be obtained from the obtained distributions. 13 channels of 2.001 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm and 32.00 μm to less than 40.30 μm are used and particles having a particle diameter of 2.00 μm or more and/or less than 40.30 μm are surveyed.

—Average Degree of Circularity—

A method of using optical detection band, in which suspension liquid containing particles is passed through the imaging portion detection band of flat plate, the particle image is optically detected by using CCD camera and investigated, is appropriate as a measurement method of circularity degree. The value obtained by dividing boundary length of corresponsive circle, which has an equal projection area obtained by this method, with the boundary length of existing particle is an average degree of circularity. This value is a measured value of average degree of circularity obtained by means of a flow particle image analyzer, FPIA-2000. The specific measurement method includes adding 0.1 ml to 0.5 ml of surfactant, preferably alkylbenzene sulfonate, in 100 ml to 150 ml of water in a container from which impure solids are removed in advance and further adding approximately 0.1 g to 0.5 g of measurement sample. The suspension liquid in which the sample is dispersed is subject to dispersion treatment for approximately 1 minute to 3 minutes using an ultrasonic disperser to make a density of dispersion liquid 3,000/μl to 10,000/μl and the average degree of circularity is obtained by measuring forms and distributions of the toner using above equipment.

—Softening Point (Tm)—

1.5 g of measurement sample was weighed and measured using a flow tester (CFT-500 manufactured by Shimadzu Corporation) and a die of 1.0 mm height and 1.0 mm diameter in a condition of temperature rise speed of 3.0° C./min., pre-heating time of 180 seconds, loading of 30 kg and a measuring temperature region of 80° C. to 140° C. The temperature at which a half of the above sample was discharged was assumed to be a softening point.

—Measurement of Particle Diameter of Inorganic Fine Particle—

The inorganic fine particles were embedded with a resin, a thin piece was formed by using microtome and particle diameter was measured by TEM observation.

—Measurement of Relative Permittivity—

1 g of measurement material was put in a cell for liquid (12964A type, 5 ml cell for liquid measurement), pinched by a pair of electrodes and the relative permittivity was measured by means of an impedance analyzer 1260 manufactured by Solartron Analytical division of Ametek Inc. at AC 1 MHz.

—Measurement of Volume Resistivity—

3 g of toner was pinched by a pair of electrodes of a sample box for ultra high resistivity measurement, TR42 manufactured by Advantest Corporation and the volume resistivity was measured at DC 500V using digital ultra high resistivity/nanoammeter R8340A.

—Measurement of Mohs Hardness—

The pellets for each external additive were prepared and the surface was scratched with standard material as shown in Table 4 which determines Mohs hardness and the hardness was measured by presence or absence of scratches. The Mohs hardness chart is shown in Table 4. The ones fall in between are expressed by a half of the value.

<Actual Performance Evaluation>

—One-Component System Development—

2,000 sheets of a specific print pattern with a printing ratio of 6% were repeatedly printed under N/N environment (23° C., 45%) using an image forming apparatus (IPSiO CX2500 manufactured by Ricoh Company, Ltd.). The condition of developing roller in the development apparatus, printed image, filming and scratches on the photoconductor were visually observed and evaluated.

The evaluation standard is as follow.

A: good

B: poses no problems for practical use

C: no good for practical use

TABLE 1

| | | External Additive First Inorganic Fine Particle | | | | | | Composition of Development Apparatus | |
|---|---|---|---|---|---|---|---|---|---|
| | Toner | Type | Primary Particle Diameter [μm] | Relative Permittivity [–] | Electrical Resistance [Ω · cm] | Mohs Hardness | Content [parts by mass] | Roller | Blade |
| Example 1 | Magenta Toner 1 | $Mg_2SiO_4$ | 0.08 | 6 | $2.0 \times 10^{14}$ | 7 | 0.4 | metal | resin |
| Example 2 | Magenta Toner 2 | $Mg_2SiO_4$ | 0.08 | 6 | $2.0 \times 10^{14}$ | 7 | 0.1 | metal | resin |
| Example 3 | Magenta Toner 3 | $Mg_2SiO_4$ | 0.08 | 6 | $2.0 \times 10^{14}$ | 7 | 1.5 | metal | resin |

TABLE 1-continued

| | | | | | | | | | |
|---|---|---|---|---|---|---|---|---|---|
| Example 4 | Magenta Toner 4 | $Mg_2SiO_4$ | 0.98 | 6 | $2.0 \times 10^{14}$ | 7 | 0.4 | metal | resin |
| Example 5 | Magenta Toner 5 | $Mg_2SiO_4$ | 0.22 | 6 | $2.0 \times 10^{14}$ | 7 | 0.4 | metal | resin |
| Example 6 | Magenta Toner 6 | $MgSiO_3$ | 0.2 | 6.3 | $2.4 \times 10^{14}$ | 6 | 0.4 | metal | resin |
| Example 7 | Magenta Toner 7 | $Mg_2SiO_4$ | 0.08 | 6 | $2.0 \times 10^{14}$ | 7 | 0.4 | resin | metal |
| Example 8 | Magenta Toner 8 | $Mg_2SiO_4$ | 0.08 | 6 | $2.0 \times 10^{14}$ | 7 | 0.05 | metal | resin |
| Example 9 | Magenta Toner 9 | $Mg_2SiO_4$ | 0.08 | 6 | $2.0 \times 10^{14}$ | 7 | 1.7 | metal | resin |
| Comp. Ex. 1 | Magenta Toner 10 | $SrTiO_3$ | 0.1 | 330 | $3.70 \times 10^{7}$ | 6 | 0.4 | metal | resin |
| Comp. Ex. 2 | Magenta Toner 11 | $SrTiO_3$ (silicone oil-treated) | 0.1 | 335 | $1.20 \times 10^{11}$ | 6 | 0.4 | metal | resin |
| Comp. Ex. 3 | Magenta Toner 12 | $TiO_2$ | 0.19 | 48 | $4.00 \times 10^{4}$ | 6 | 0.4 | metal | resin |

| | Evaluation | | | | | | |
|---|---|---|---|---|---|---|---|
| | Background Smear | Toner Leakage | Streak | Image Density | Filming on Photoconductor | Scratch on Photoconductor | Cracked Image by Smeary Charging Roller |
| Example 1 | A | A | A | A | A | A | A |
| Example 2 | B | B | B | A | A | A | A |
| Example 3 | B | A | A | A | A | A | A |
| Example 4 | A | B | B | A | A | A | A |
| Example 5 | A | A | A | A | A | A | A |
| Example 6 | A | A | A | A | A | A | A |
| Example 7 | A | A | A | A | A | A | A |
| Example 8 | A | B | B | A | A | A | A |
| Example 9 | B | B | A | A | A | A | A |
| Comp. Ex. 1 | C | C | C | A | A | A | C |
| Comp. Ex. 2 | B | B | C | C | A | A | B |
| Comp. Ex. 3 | C | B | B | A | A | A | C |

All of them are added with 1 parts by mass of silica RX200 as a second inorganic fine particle.
All latent electrostatic image bearing members are charged with contact method.

TABLE 2

| | Type | Primary Particle Diameter [μm] | Relative Permittivity [−] | Electrical Resistance [Ω · cm] | Mohs Hardness [−] |
|---|---|---|---|---|---|
| Inorganic Oxide 1 | $Mg_2SiO_4$ | 0.08 | 6 | $2.0 \times 10^{14}$ | 7 |
| Inorganic Oxide 2 | $Mg_2SiO_4$ | 0.98 | 6 | $1.9 \times 10^{14}$ | 7 |
| Inorganic Oxide 3 | $MgSiO_3$ | 0.20 | 6.3 | $2.4 \times 10^{14}$ | 7 |

TABLE 2-continued

| | Type | Primary Particle Diameter [μm] | Relative Permittivity [−] | Electrical Resistance [Ω · cm] | Mohs Hardness [−] |
|---|---|---|---|---|---|
| Inorganic Oxide 4 | $SrTiO_3$ | 0.10 | 330 | $3.70 \times 10^{7}$ | 6 |
| Inorganic Oxide 5 | $Al_2O_3$ | 0.20 | 9.5 | $5.7 \times 10^{13}$ | 9 |

TABLE 3

| Examples and Comparative Examples | Toner Base | External Additive 1 H1303*1) | External Additive 2 STT-30S*2) | Inorganic Oxide 1 | Inorganic Oxide 2 | Inorganic Oxide 3 | Inorganic Oxide 4 | Inorganic Oxide 5 |
|---|---|---|---|---|---|---|---|---|
| Example 10 | B | 1.2 | | 1.5 | | | | |
| Example 11 | B | 1.2 | 0.4 | 2.5 | | | | |
| Example 12 | B | 3 | 0.6 | 1 | | | | |
| Example 13 | B | 1.2 | 0.6 | | 1 | | | |
| Example 14 | B | 1.2 | 0.6 | | | 1 | | |
| Example 15 | B | 1.2 | 1 | 0.5 | | | | |
| Example 16 | B | 1.2 | 1 | 2 | | | | |
| Example 17 | C | 1.5 | 1 | 1.5 | | | | |
| Example 18 | C | 1 | 0.8 | 1 | | | | |
| Example 19 | B | 1.2 | 0.6 | 5.5 | | | | |
| Comp. Ex. 4 | B | 1.2 | 0.6 | | | | 1 | |
| Comp. Ex. 5 | B | 1.2 | 0.6 | | | | | 1 |
| Comp. Ex. 6 | B | 1.2 | 0.6 | | | | | |

TABLE 3-continued

| Examples and Comparative Examples | Low Temperature Low Humidity Environment*3) Image Density and Following Ability Initial | After 100,000 times | Fog ΔE Initial | After 100,000 times | High Temperature High Humidity Environment*4) Image Density and Following Ability Initial | After 100,000 times | Fog ΔE Initial | After 100,000 times |
|---|---|---|---|---|---|---|---|---|
| Example 10 | A | B | 1.2 | 3.9 | A | B | 2.0 | 4.2 |
| Example 11 | A | A | 1.8 | 2.4 | A | B | 2.4 | 3.8 |
| Example 12 | A | A | 1.4 | 1.9 | A | B | 1.9 | 2.5 |
| Example 13 | A | B | 0.9 | 3.5 | A | B | 2.4 | 3.9 |
| Example 14 | A | B | 2.1 | 3.8 | A | B | 2.1 | 4.1 |
| Example 15 | A | B | 1.8 | 2.8 | A | B | 2.4 | 3.8 |
| Example 16 | A | A | 1.8 | 2.4 | A | B | 1.9 | 3.6 |
| Example 17 | A | A | 2.0 | 3.5 | A | B | 2.7 | 2.9 |
| Example 18 | A | B | 1.4 | 2.9 | A | C | 1.8 | 3.7 |
| Example 19 | A | C | 2.8 | 6.8 | B | C | 3.5 | 19.8 |
| Comp. Ex. 4 | A | D | 2.2 | 13.2 | A | C | 2.5 | 6.2 |
| Comp. Ex. 5 | B | D | 3.8 | 20.2 | B | D | 4.5 | 29.0 |
| Comp. Ex. 6 | A | D | 2.4 | 7.1 | B | C | 3.7 | 9.8 |

*1)silica manufactured by Clariant (Japan) K.K.
*2)titania manufactured by Titan Kogyo K.K.
*3)low temperature, low humidity environment (temperature of 10° C. and relative humidity of 15%)
*4)high temperature, high humidity environment (temperature of 30° C. and relative humidity of 80%)

TABLE 4

| Hardness No. | Hardness Meter | Chemical Composition |
|---|---|---|
| 1 | talc | $Mg_3(Si_4O_{10})(OH)_2$ |
| 2 | gypsum | $CaSO_4 \cdot 2H_2O$ |
| 3 | calcite | $CaCO_3$ |
| 4 | fluorite | $CaF_2$ |
| 5 | apatite | $Ca_5F(PO_4)_3$ |
| 6 | orthoclaes | $K(AlSiO_8)$ |
| 7 | quartz | $SiO_2$ |
| 8 | topaz | $Al_2(F,OH)_2(SiO_4)$ |
| 9 | corundum | $Al_2O_3$ |
| 10 | diamond | C |

What is claimed is:

1. A toner comprising:

toner particles; and inorganic fine particles, wherein the inorganic fine particles are externally added to the toner particles which comprise a binder resin and a colorant, and wherein the inorganic fine particles comprise forsterite having a relative permittivity measured at 1 MHz of 2 to 10 and a volume resistivity of $10^{11}\Omega\cdot$cm or more.

2. The toner according to claim 1, wherein a primary particle diameter of the inorganic fine particles is 0.05 μm to 1 μm and 0.1 parts by mass to 5.0 parts by mass of the inorganic fine 20 particles are added relative to 100 parts by mass of the toner particles.

3. The toner according to claim 1, wherein the toner is a full-color toner at least selected from magenta, cyan, yellow and black.

4. The toner according to claim 1, wherein the toner contains at least one or more types of releasing agent and the content of the releasing agent in the toner particles is 1% by mass to 10% by mass.

5. A single component developer comprising:

a toner, wherein the toner comprises:

toner particles; and inorganic fine particles, wherein the inorganic fine particles are externally added to the toner particles which comprise a binder resin and a colorant, and wherein the inorganic fine particles comprise forsterite having a relative permittivity measured at 1 MHz of 2 to 10 and a volume resistivity of $10^{11}\Omega\cdot$cm or more.

6. A two-component developer comprising:

a toner; and a carrier, wherein the toner comprises a toner in accordance with claim 1.

7. An image forming method comprising:

forming of a latent electrostatic image on a latent electrostatic image bearing member, developing of the latent electrostatic image using a toner to form a visible image, transferring of the visible image to a recording medium, and fixing of the transferred image on the recording medium, wherein the toner comprises a toner in accordance with claim 1.

8. The image forming method according to claim 7, wherein a primary charging of the latent electrostatic image bearing member is performed by contact charging.

9. The image forming method according to claim 7, wherein the developing of a latent image on the latent electrostatic image bearing member is performed by an application of an alternate electric field.

10. The image forming method according to claim 7, wherein the transferring is performed by means of an intermediate transfer body on which a toner image formed on the latent electrostatic image bearing member is primarily transferred and a transfer unit by which the toner image on the intermediate transfer body is secondarily transferred to a recording medium.

11. The image forming method according to claim 7, wherein the developing step is performed with a developer comprising the toner, wherein the developer is any one of single component developer and two-component developer.

12. An image-forming apparatus comprising:

a latent electrostatic image bearing member, latent electrostatic image forming unit configured to form a latent electrostatic image on the latent electrostatic image bearing member, developing unit configured to develop the latent electrostatic image using a toner to form a visible image, transfer unit configured to transfer the visible image to a recording medium, and fixing unit configured to fix the transferred image on the recording medium, wherein the toner comprises a toner in accordance with claim 1.

13. The image-forming apparatus according to claim 12, wherein the developing unit comprises a developing roller and a developer layer thickness control member which controls a layer thickness of a developer formed on the surface of the developing roller.

14. The image-forming apparatus according to claim 13, wherein a surface layer of the developing roller at least comprises a metal and a surface layer of the developer layer thickness control member at least comprises an elastic body.

15. The image-forming apparatus according to claim 13, wherein a surface layer of the developing roller at least comprises an elastic body and a surface layer of the developer layer thickness control member at least comprises a metal.

16. The image-forming apparatus according to claim 12, wherein the fixing unit is a thermal roll fixing apparatus and the fixing apparatus does not comprise an oil coating mechanism to provide demolding property.

17. A process cartridge comprising:

a latent electrostatic image bearing member, a developing unit configured to develop a latent electrostatic image formed on the latent electrostatic image bearing member using a toner to form a visible image, wherein the process cartridge can be attached to, and removed from the image-forming apparatus main body, wherein the toner comprises a toner in accordance with claim 1.

* * * * *

UNITED STATES PATENT AND TRADEMARK OFFICE

CERTIFICATE OF CORRECTION

PATENT NO. : 7,556,904 B2
APPLICATION NO. : 11/411179
DATED : July 7, 2009
INVENTOR(S) : Kadota et al.

It is certified that error appears in the above-identified patent and that said Letters Patent is hereby corrected as shown below:

On the title page, Item (54), and Column 1, the title information is incorrect. Item (54) and Column 1 should read:

-- (54) TONER FOR ELECTROSTATIC DEVELOPMENT, DEVELOPER, IMAGE FORMING METHOD, IMAGE-FORMING APPARATUS AND PROCESS CARTRIDGE USING THE SAME --

Signed and Sealed this

Twenty-second Day of September, 2009

David J. Kappos

David J. Kappos
*Director of the United States Patent and Trademark Office*